US011726430B2

(12) United States Patent
Furuichi

(10) Patent No.: US 11,726,430 B2
(45) **Date of Patent: *Aug. 15, 2023**

(54) IMAGE FORMING APPARATUS

(71) Applicant: Yuusuke Furuichi, Kanagawa (JP)

(72) Inventor: Yuusuke Furuichi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/497,306

(22) Filed: Oct. 8, 2021

(65) Prior Publication Data

US 2022/0043391 A1 Feb. 10, 2022

Related U.S. Application Data

(63) Continuation of application No. 16/942,072, filed on Jul. 29, 2020, now Pat. No. 11,163,264.

(30) Foreign Application Priority Data

Aug. 8, 2019 (JP) ..... 2019-146406
Aug. 16, 2019 (JP) ..... 2019-149354
(Continued)

(51) Int. Cl.
*G03G 15/20* (2006.01)
*G03G 21/20* (2006.01)

(52) U.S. Cl.
CPC ..... *G03G 21/206* (2013.01); *G03G 15/2017* (2013.01); *G03G 15/2039* (2013.01); *G03G 15/2053* (2013.01)

(58) Field of Classification Search
CPC ..... G03G 15/2017; G03G 15/2053; G03G 21/20; G03G 21/206
See application file for complete search history.

(56) References Cited

U.S. PATENT DOCUMENTS 6,327,447 B1 12/2001 Nakano et al.
9,354,570 B2 5/2016 Arimoto et al.
(Continued)

FOREIGN PATENT DOCUMENTS

CN 101097432 A 1/2008
CN 101221387 A 7/2008
(Continued)

OTHER PUBLICATIONS

U.S. Office Action for corresponding U.S. Appl. No. 16/942,072 dated Feb. 3, 2021.
(Continued)

*Primary Examiner* — Thomas S Giampaolo, II
(74) *Attorney, Agent, or Firm* — Harness, Dickey & Pierce, P.L.C.

(57) ABSTRACT

An image forming apparatus includes a cooler and a heater. The heater includes a heat generation unit, which includes resistive heat generators arranged in a longitudinal direction of the heater, a first electrode, a second electrode, a first conductor that connects the resistive heat generators in parallel with each other to the first electrode, and a second conductor that connects the resistive heat generators in parallel with each other to the second electrode. The first and second conductors are connected to at least one of the resistive heat generators on a first longitudinal end side of the heater from a center of the resistive heat generator in the longitudinal direction of the heater. A cooling ability of the cooler to a second longitudinal end side of the heater opposite the first longitudinal end side of the heater is greater than that to the first longitudinal end side of the heater.

16 Claims, 19 Drawing Sheets

(30) Foreign Application Priority Data

Mar. 2, 2020 (JP) ..... 2020-034912
Mar. 31, 2020 (JP) ..... 2020-063726

(56) References Cited

U.S. PATENT DOCUMENTS

| | | | | |
|---|---|---|---|---|
| 10,281,857 | B1 | 5/2019 | Aikawa | |
| 11,163,264 | B2 * | 11/2021 | Furuichi | G03G 15/2042 |
| 2003/0230564 | A1 | 12/2003 | Yoshimura | |
| 2007/0182798 | A1 * | 8/2007 | Makihira | H05B 3/0095 347/102 |
| 2009/0297204 | A1 | 12/2009 | Kaji | |
| 2010/0008691 | A1 | 1/2010 | Fujiwara | |
| 2012/0014706 | A1 | 1/2012 | Kaji | |
| 2012/0201582 | A1 | 8/2012 | Shimura et al. | |
| 2013/0071136 | A1 | 3/2013 | Gon | |
| 2013/0188978 | A1 | 7/2013 | Takeuchi | |
| 2013/0299480 | A1 | 11/2013 | Kakubari et al. | |
| 2013/0322897 | A1 | 12/2013 | Yago et al. | |
| 2014/0178091 | A1 | 6/2014 | Sugiyama et al. | |
| 2014/0212191 | A1 | 7/2014 | Matsusaka et al. | |
| 2015/0037052 | A1 | 2/2015 | Muramatsu et al. | |
| 2015/0063857 | A1 | 3/2015 | Battat et al. | |
| 2015/0227091 | A1 * | 8/2015 | Ando | G03G 15/2053 399/33 |
| 2015/0341986 | A1 | 11/2015 | Nakayama | |
| 2016/0098009 | A1 | 4/2016 | Aoki et al. | |
| 2018/0006520 | A1 | 1/2018 | Ishimoto et al. | |
| 2018/0356753 | A1 | 12/2018 | Okugawa et al. | |
| 2019/0179242 | A1 | 6/2019 | Adachi et al. | |
| 2020/0103797 | A1 | 4/2020 | Furuichi | |
| 2020/0103803 | A1 | 4/2020 | Furuichi | |
| 2020/0117124 | A1 | 4/2020 | Furuichi | |
| 2020/0117125 | A1 | 4/2020 | Furuichi | |
| 2020/0174407 | A1 | 6/2020 | Furuichi | |
| 2021/0041832 | A1 | 2/2021 | Furuichi | |

FOREIGN PATENT DOCUMENTS

| | | | |
|---|---|---|---|
| CN | 101551630 | A | 10/2009 |
| CN | 101561655 | A | 10/2009 |
| CN | 102004427 | A | 4/2011 |
| CN | 102073234 | A | 5/2011 |
| CN | 105301938 | A | 2/2016 |
| CN | 105319914 | A | 2/2016 |
| CN | 105739270 | A | 7/2016 |
| CN | 105758902 | A | 7/2016 |
| CN | 106134284 | A | 11/2016 |
| CN | 107526274 | A | 12/2017 |
| CN | 108196435 | A | 6/2018 |
| CN | 108496048 | A | 9/2018 |
| CN | 109407490 | A | 3/2019 |
| JP | H06-130852 | A | 5/1994 |
| JP | H06-282185 | A | 10/1994 |
| JP | 2008-089739 | A | 4/2008 |
| JP | 2010-177142 | A | 8/2010 |
| JP | 2011-151003 | A | 8/2011 |
| JP | 2013-071272 | A | 4/2013 |
| JP | 2013-172168 | A | 9/2013 |
| JP | 2013-174868 | A | 9/2013 |
| JP | 2014-145966 | A | 8/2014 |
| JP | 2014-178509 | A | 9/2014 |
| JP | 2016-062024 | A | 4/2016 |
| JP | 2016-206256 | A | 12/2016 |
| JP | 2017-003872 | A | 1/2017 |
| JP | 2017-054103 | A | 3/2017 |
| JP | 2017-191149 | A | 10/2017 |
| JP | 2018-007417 | A | 1/2018 |
| JP | 2018-194825 | | 12/2018 |
| JP | 2019-035944 | A | 3/2019 |

OTHER PUBLICATIONS

Office action dated Mar. 4, 2021, issued in corresponding U.S. Appl. No. 16/941,800.
Notice of Allowance dated Jun. 10, 2021, issued in corresponding U.S. Appl. No. 16/941,800.
Notice of Allowance dated Jun. 25, 2021, issued in corresponding U.S. Appl. No. 16/942,072.
Chinese Office Action dated Nov. 18, 2022 for corresponding Chinese Patent Application No. 202010776351.7.
Chinese Office Action dated Dec. 1, 2022 for corresponding Chinese Patent Application No. CN202010780542.0.
Chinese Notice of Allowance dated Apr. 20, 2023 for corresponding Chinese Patent Application No. CN202010776351.7.

* cited by examiner

| | FIRST BLOCK | SECOND BLOCK | THIRD BLOCK | FOURTH BLOCK | FIFTH BLOCK |
|---|---|---|---|---|---|
| AMOUNT OF HEAT GENERATED BY FIRST FEED LINE 62A | 10000 | 6400 | 3600 | 1600 | 400 |
| AMOUNT OF HEAT GENERATED BY SECOND FEED LINE 62B | 400 | 1600 | 3600 | 6400 | 10000 |
| TOTAL AMOUNT OF HEAT GENERATED | 10400 | 8000 | 7200 | 8000 | 10400 |

| | FIRST BLOCK | SECOND BLOCK | THIRD BLOCK | FOURTH BLOCK | FIFTH BLOCK |
|---|---|---|---|---|---|
| AMOUNT OF HEAT GENERATED BY FIRST FEED LINE 62A | 10000 | 6400 | 3600 | 1600 | 400 |
| AMOUNT OF HEAT GENERATED BY SECOND FEED LINE 62B | — | 400 | 1600 | 3600 | 6400 |
| TOTAL AMOUNT OF HEAT GENERATED | 10000 | 6800 | 5200 | 5200 | 6800 |

| | FIRST BLOCK | SECOND BLOCK | THIRD BLOCK | FOURTH BLOCK | FIFTH BLOCK |
|---|---|---|---|---|---|
| AMOUNT OF HEAT GENERATED BY FIRST FEED LINE 62A | 6400 | 3600 | 1600 | 400 | — |
| AMOUNT OF HEAT GENERATED BY SECOND FEED LINE 62B | 400 | 1600 | 3600 | 6400 | 10000 |
| TOTAL AMOUNT OF HEAT GENERATED | 6800 | 5200 | 5200 | 6800 | 10000 |

IMAGE FORMING APPARATUS

CROSS-REFERENCE TO RELATED APPLICATIONS

This patent application is is a Continuation of U.S. application Ser. No. 16/942,072, filed on Jul. 29, 2020, which claims priority pursuant to 35 U.S.C. § 119(a) to Japanese Patent Application Nos. 2019-146406, filed on Aug. 8, 2019, 2019-149354, filed on Aug. 16, 2019, 2020-034912, filed on Mar. 2, 2020, and 2020-063726, filed on Mar. 31, 2020, in the Japan Patent Office, the entire disclosure of each of which is hereby incorporated by reference herein.

BACKGROUND

Technical Field

Embodiments of the present disclosure relate to an image forming apparatus.

Related Art

Various types of image forming apparatuses are known, including copiers, printers, facsimile machines, and multi-function machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly or indirectly via an intermediate transfer belt. Finally, a fixing device applies heat and pressure to the recording medium bearing the toner image to fix the toner image onto the recording medium. Thus, an image is formed on the recording medium.

The image forming apparatuses often include a heating device. One example of the heating device is the fixing device that fixes toner onto a recording medium under heat. Another example of the heating device is a drying device that dries ink on a recording medium.

SUMMARY

In one embodiment of the present disclosure, a novel image forming apparatus includes a cooler and a heater. The heater includes a heat generation unit, a first electrode, a second electrode, a first conductor, and a second conductor. The heat generation unit includes resistive heat generators arranged in a longitudinal direction of the heater. The first conductor is configured to connect the resistive heat generators in parallel with each other to the first electrode. The second conductor is configured to connect the resistive heat generators in parallel with each other to the second electrode. The first conductor and the second conductor are connected to at least a resistive heat generator of the resistive heat generators on a first longitudinal end side of the heater from a center of the resistive heat generator in the longitudinal direction of the heater. A cooling ability of the cooler to a second longitudinal end side of the heater opposite the first longitudinal end side of the heater is greater than the cooling ability to the first longitudinal end side of the heater.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
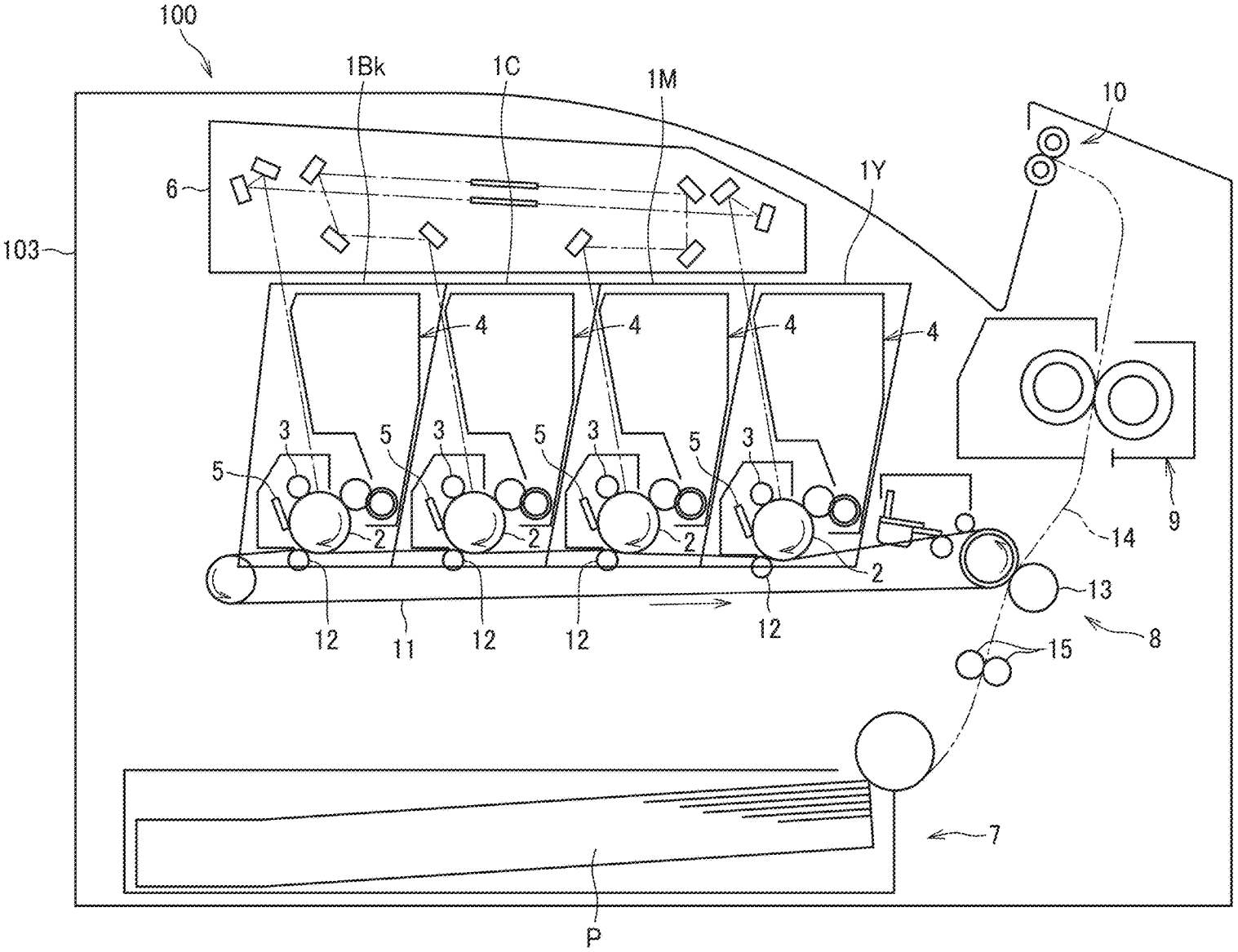
FIG. 1 is a schematic cross-sectional view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a," "an," and "the" are intended to include the plural forms as well, unless the context clearly indicates otherwise.

It is to be noted that, in the following description, suffixes Y, M, C, and Bk denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Initially with reference to FIG. 1, a description is given of an image forming apparatus 100 according to an embodiment of the present disclosure.

FIG. 1 is a schematic cross-sectional view of the image forming apparatus 100.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in a body 103 of the image forming apparatus 100. The image forming units 1Y, 1M, 1C, and 1Bk have identical configurations, except that the image forming units 1Y, 1M, 1C, and 1Bk contain developers in different colors, namely, yellow (Y), magenta (M), cyan (C), and black (Bk), respectively. The yellow, magenta, cyan, and black correspond to color-separation components of a color image. Specifically, each of the image forming units 1Y, 1M, 1C, and 1Bk includes a drum-shaped photoconductor 2, a charger 3, a developing device 4, and a cleaner 5. The photoconductor 2 serves as an image bearer that bears an electrostatic latent image and a resultant toner image. The charger 3 charges a circumferential surface of the photoconductor 2. The developing device 4 supplies toner as a developer to the electrostatic latent image formed on the circumferential surface of the photoconductor 2, rendering the electrostatic latent image visible as a toner image. In short, the developing device 4 forms a toner image on the photoconductor 2. The cleaner 5 cleans the circumferential surface of the photoconductor 2.

The image forming apparatus 100 further includes an exposure device 6, a sheet feeding device 7, a transfer device 8, a fixing device 9, and a sheet ejection device 10. The exposure device 6 exposes the circumferential surface of the photoconductor 2 to form an electrostatic latent image. The sheet feeding device 7 feeds or supplies a sheet P serving as a recording medium. The transfer device 8 transfers the toner image from the photoconductor 2 onto the sheet P. The fixing device 9 fixes the toner image onto the sheet P. The sheet ejection device 10 ejects the sheet P outside the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor entrained around a plurality of rollers. Each of the four primary transfer rollers 12 serves as a primary transferor that transfers the toner image from the corresponding photoconductor 2 onto the intermediate transfer belt 11. The secondary transfer roller 13 serves as a secondary transferor that transfers the toner images from the intermediate transfer belt 11 onto the sheet P. The four primary transfer rollers 12 contact the respective photoconductors 2 via the intermediate transfer belt 11. In other words, each of the photoconductors 2 contacts the intermediate transfer belt 11, thereby forming an area of contact, herein referred to as a primary transfer nip, between each of the photoconductors 2 and the intermediate transfer belt 11. On the other hand, the secondary transfer roller 13 contacts, via the intermediate transfer belt 11, one of the plurality of rollers around which the intermediate transfer belt 11 is entrained. Thus, the secondary transfer roller 13 forms an area of contact, herein referred to as a secondary transfer nip, between the secondary transfer roller 13 and the intermediate transfer belt 11.

Inside the image forming apparatus 100, the sheet P is conveyed from the sheet feeding device 7 along a sheet conveyance passage 14 that is defined by internal components of the image forming apparatus 100. A timing roller pair 15 is disposed between the sheet feeding device 7 and the secondary transfer nip (defined by the secondary transfer roller 13) on the sheet conveyance passage 14.

To provide a fuller understanding of the embodiments of the present disclosure, a description is now given of a series of image forming operations of the image forming apparatus 100 with continued reference to FIG. 1.

When the image forming apparatus 100 receives an instruction to start a print job (i.e., a series of image forming operations), a driver drives and rotates the photoconductor 2 clockwise in FIG. 1 in each of the image forming units 1Y, 1M, 1C, and 1Bk. The charger 3 charges the circumferential surface of the photoconductor 2 uniformly at a high electric potential. According to image information of a document read by a document reading device or print information instructed to print from a terminal, the exposure device 6 exposes the circumferential surface of each of the photoconductors 2 to decrease the electrostatic potential at an exposed portion, thereby forming an electrostatic latent image on the circumferential surface of each of the photoconductors 2. The developing device 4 supplies toner to the electrostatic latent image, rendering the electrostatic latent image visible as a toner image. Thus, the developing device 4 forms a toner image on the photoconductor 2.

The toner image thus formed on the photoconductor 2 reaches the primary transfer nip (defined by the primary transfer roller 12) as the photoconductor 2 rotates. At the primary transfer nip, the toner image is transferred onto the intermediate transfer belt 11 that is rotated counterclockwise in FIG. 1. Specifically, the toner images are sequentially transferred from the respective photoconductors 2 onto the intermediate transfer belt 11 such that the toner images are superimposed one atop another, as a composite full-color toner image on the intermediate transfer belt 11. The full-color toner image on the intermediate transfer belt 11 is conveyed to the secondary transfer nip (defined by the secondary transfer roller 13) as the intermediate transfer belt 11 rotates. At the secondary transfer nip, the full-color toner image is transferred onto the sheet P supplied and conveyed from the sheet feeding device 7. Specifically, the sheet P supplied from the sheet feeding device 7 is temporarily stopped by the timing roller pair 15. Rotation of the timing roller pair 15 is timed to send out the sheet P to the secondary transfer nip such that the sheet P meets the full-color toner image on the intermediate transfer belt 11 at the secondary transfer nip. Thus, the full-color toner image is transferred onto the sheet P. In other words, the sheet P bears the full-color toner image. Note that after the toner image is transferred from the photoconductor 2 onto the intermediate transfer belt 11, the cleaner 5 removes residual toner from the photoconductor 2. The residual toner herein refers to toner that has failed to be transferred onto the intermediate transfer belt 11 and therefore remains on the surface of the photoconductor 2.

The sheet P bearing the full-color toner image is conveyed to the fixing device 9, which fixes the full-color toner image onto the sheet P. Thereafter, the sheet ejection device 10 ejects the sheet P outside the image forming apparatus 100. Thus, a series of image forming operations is completed.

Figure 2:
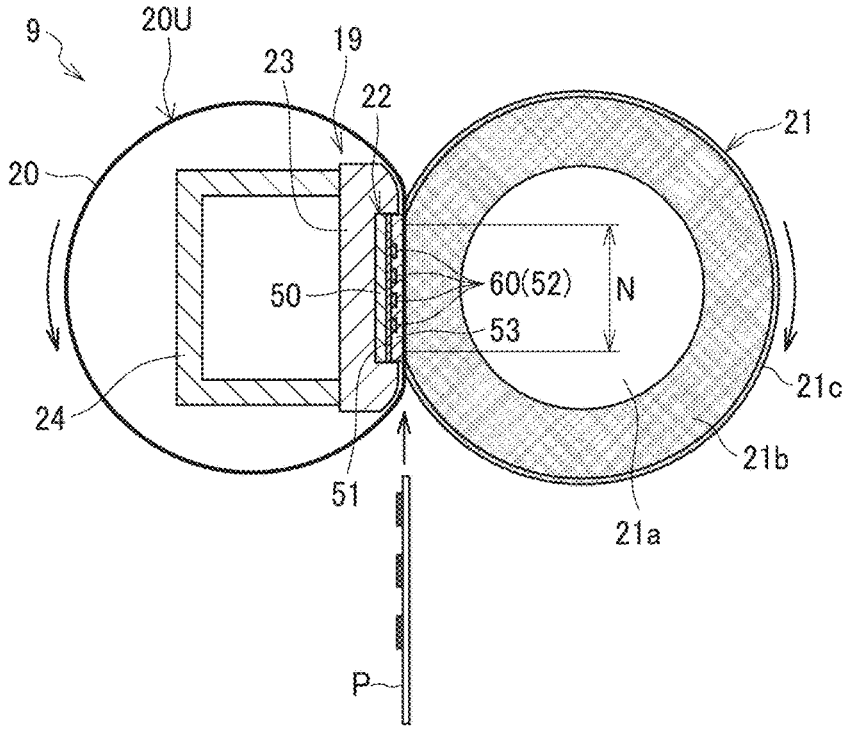
FIG. 2 is a schematic cross-sectional view of a fixing device incorporated in the image forming apparatus.

Referring now to FIG. 2, a description is given of a configuration of the fixing device 9 incorporated in the image forming apparatus 100 described above.

FIG. 2 is a schematic cross-sectional view of the fixing device 9.

As illustrated in FIG. 2, the fixing device 9 according to the present embodiment includes a heating device 19, a fixing belt 20, and a pressure roller 21. The fixing belt 20 and the heating device 19 disposed inside a loop formed by the fixing belt 20 constitute a belt unit 20U that is detachably coupled to the pressure roller 21. Specifically, the heating device 19 heats the fixing belt 20. The fixing belt 20 is an endless belt serving as a fixing rotator. The pressure roller 21 contacts an outer circumferential surface of the fixing belt 20 to form an area of contact, herein referred to as a fixing nip N, between the fixing belt 20 and the pressure roller 21. Since the pressure roller 21 is disposed opposite the fixing belt 20, the pressure roller 21 serves as an opposed rotator. The heating device 19 includes, e.g., a planar heater 22, a heater holder 23, and a stay 24. The heater holder 23 holds the heater 22. The stay 24 serves as a reinforcement that reinforces the heater holder 23 along a longitudinal direction of the heater holder 23.

The endless fixing belt 20 is constructed of a cylindrical base layer and a release layer. The base layer, made of polyimide (PI), has an outer diameter of 25 mm and a thickness in a range of from 40 μm to 120 μm, for example. The release layer, serving as an outermost layer of the fixing belt 20, has a thickness in a range of from 5 μm to 50 μm and is made of fluororesin such as tetrafluoroethylene-perfluoroalkylvinylether copolymer or perfluoroalkylvinyl ether polymer (PFA) or polytetrafluoroethylene (PTFE), to enhance durability of the fixing belt 20 and facilitate separation of toner, which is contained in a toner image on the sheet P, from the fixing belt 20. Optionally, an elastic layer made of, e.g., rubber having a thickness in a range of from 50 μm to 500 μm may be interposed between the base layer and the release layer. The base layer of the fixing belt 20 is not limited to polyimide. Alternatively, the base layer of the fixing belt 20 may be made of heat resistant resin such as polyether ether ketone (PEEK), or metal such as nickel (Ni) or steel use stainless (SUS). An inner circumferential surface of the fixing belt 20 may be coated with, e.g., PI or PTFE to produce a slide layer.

The pressure roller 21 has an outer diameter of 25 mm, for example. The pressure roller 21 is constructed of a core 21*a*, an elastic layer 21*b*, and a release layer 21*c*. The core 21*a* is a solid core made of iron. The elastic layer 21*b* rests on a circumferential surface of the core 21*a*. The release layer 21*c* rests on an outer circumferential surface of the elastic layer 21*b*. The elastic layer 21*b* is made of silicone rubber and has a thickness of 3.5 mm, for example. The release layer 21*c* resting on the outer circumferential surface of the elastic layer 21*b* is preferably a fluoroplastic layer having a thickness of about 40 μm, for example, to facilitate separation of the sheet P and a foreign substance from the pressure roller 21.

A spring serving as a biasing member described later causes the fixing belt 20 and the pressure roller 21 to press against each other. Thus, the fixing nip N is formed between the fixing belt 20 and the pressure roller 21. As a driving force is transmitted to the pressure roller 21 from a driver disposed in the body 103 of the image forming apparatus 100, the pressure roller 21 rotates and serves as a driving roller that drives and rotates the fixing belt 20. The fixing belt 20 is thus driven and rotated by the pressure roller 21 as the pressure roller 21 rotates. When the fixing belt 20 rotates, the fixing belt 20 slides on the heater 22. Therefore, in order to facilitate sliding of the fixing belt 20, a lubricant such as oil or grease may be provided between the heater 22 and the fixing belt 20.

The heater 22 is longitudinally disposed along an axial or longitudinal direction of the fixing belt 20. In other words, a longitudinal direction of the heater 22 is parallel to the longitudinal direction (i.e., axial direction) of the fixing belt 20. The heater 22 contacts the inner circumferential surface of the fixing belt 20 at a position opposite the pressure roller 21. The heater 22 is a substantially rectangular flat plate having a long side along the longitudinal direction of the fixing belt 20. The heater 22 includes, e.g., a plate-like base 50, a first insulation layer 51 resting on the base 50, a conductor layer 52 including a heat generation unit 60 and resting on the first insulation layer 51, and a second insulation layer 53 that covers the conductor layer 52. In the present embodiment, the base 50, the first insulation layer 51, the conductor layer 52 (including the heat generation unit 60), and the second insulation layer 53 are layered in this order toward the fixing belt 20, in other words, toward the fixing nip N. Heat generated from the heat generation unit 60 is conducted to the fixing belt 20 via the second insulation layer 53.

Unlike the present embodiment, the heat generation unit 60 may be provided on a heater-holder side of the base 50. The heater-holder side of the base 50 is a surface facing the heater holder 23 away from the fixing belt 20. In such a case, since the heat is conducted from the heat generation unit 60 to the fixing belt 20 via the base 50, the base 50 is preferably made of a material having an increased thermal conductivity such as aluminum nitride. The heater 22 according to the present embodiment may further include an insulation layer on the heater-holder side of the base 50.

The heater 22 may not contact the fixing belt 20 or may contact the fixing belt 20 indirectly via, e.g., a low friction sheet. In the present embodiment, the heater 22 directly contacts the fixing belt 20 to efficiently conduct heat to the fixing belt 20. The heater 22 may contact the outer circumferential surface of the fixing belt 20. By contrast, in a case in which the heater 22 contacts the inner circumferential surface of the fixing belt 20, the outer circumferential surface of the fixing belt 20 does not contact the heater 22 and therefore remains protected. Accordingly, the toner image is reliably fixed on the sheet P.

The heater holder 23 and the stay 24 are disposed opposite the inner circumferential surface of the fixing belt 20. In other words, the heater holder 23 and the stay 24 are disposed inside the loop formed by the fixing belt 20. The stay 24 includes a channel made of metal. Opposed longitudinal end portions of the stay 24 are supported by opposed side walls of the fixing device 9, respectively. The stay 24 contacts a stay side of the heater holder 23. The stay side of the heater holder 23 is a surface facing the stay 24 away from the heater 22. Accordingly, the stay 24 supports the heater holder 23 while retaining the heater 22 and the heater holder 23 to be immune from being bent substantially by pressure from the pressure roller 21. Thus, the fixing nip N is formed between the fixing belt 20 and the pressure roller 21.

The heater holder 23 is susceptible to a temperature increase or overheating as the heater holder 23 receives heat from the heater 22. Therefore, the heater holder 23 is preferably made of a heat-resistant material. For example, the heater holder 23 may be made of a heat-resistant resin having a decreased thermal conductivity such as liquid crystal polymer (LCP) or PEEK. In such a case, the heater holder 23 reduces conduction of heat from the heater 22 to the heater holder 23, allowing the heater 22 to efficiently heat the fixing belt 20.

As a print job starts, the heater 22 supplied with power causes the heat generation unit 60 to generate heat, thus heating the fixing belt 20. Meanwhile, the pressure roller 21 is rotated. The rotation of the pressure roller 21 rotates the fixing belt 20. As illustrated in FIG. 2, the sheet P bearing an unfixed toner image is conveyed through the fixing nip N between the pressure roller 21 and the fixing belt 20 that reaches a given target temperature (i.e., fixing temperature). At the fixing nip N, the unfixed toner image is fixed onto the sheet P under heat and pressure.

Figure 3:
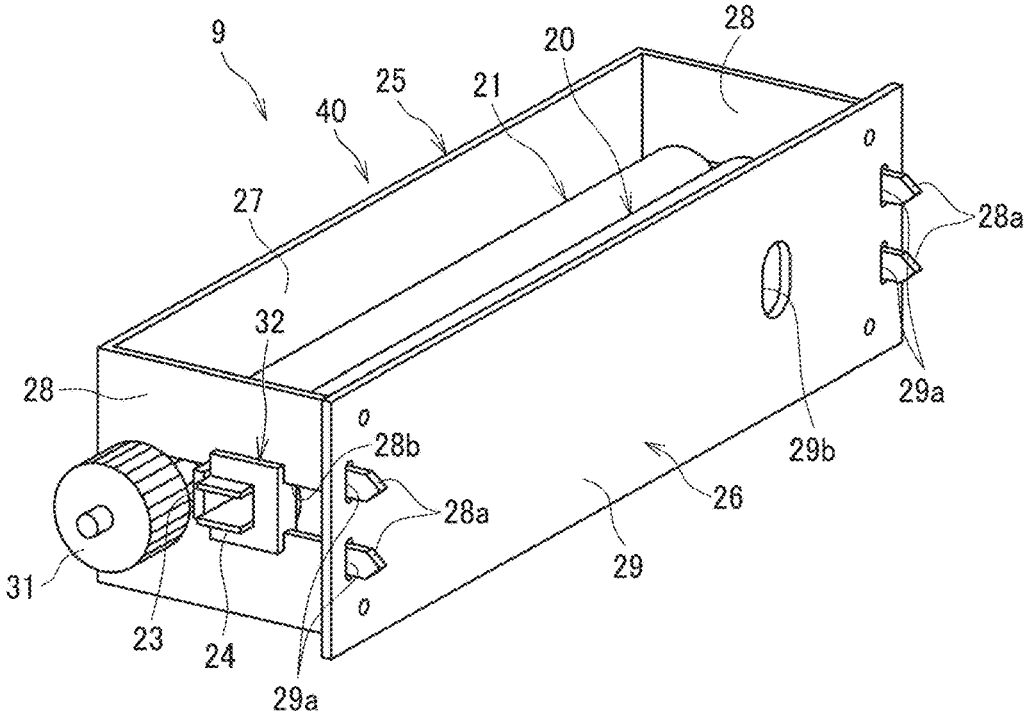
FIG. 3 is a perspective view of the fixing device.
Figure 4:
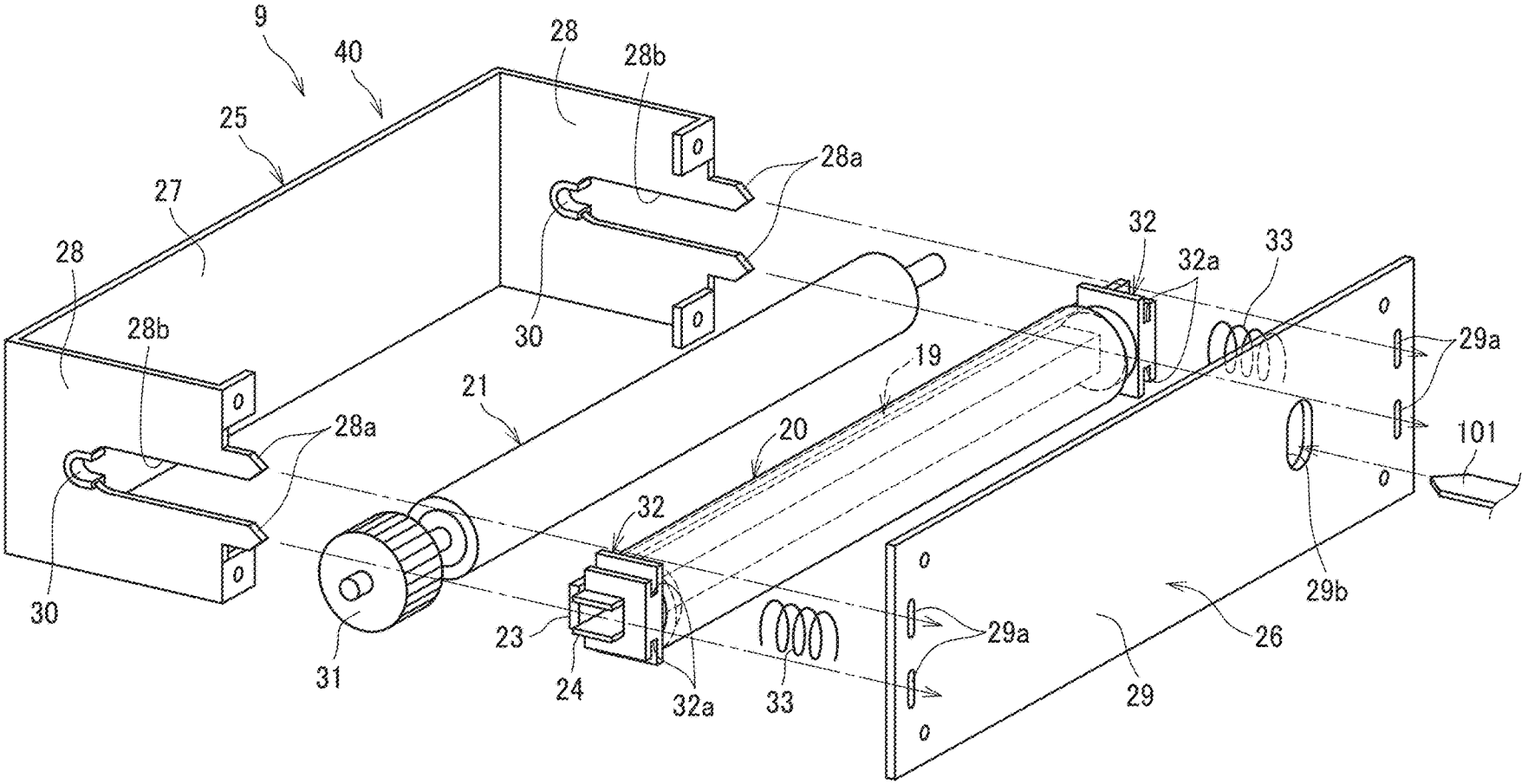
FIG. 4 is an exploded perspective view of the fixing device.

Referring now to FIGS. 3 and 4, a detailed description is given of the configuration of the fixing device 9.

FIG. 3 is a perspective view of the fixing device 9. FIG. 4 is an exploded perspective view of the fixing device 9.

As illustrated in FIGS. 3 and 4, the fixing device 9 includes a device frame 40, which includes a first device frame 25 and a second device frame 26. The first device frame 25 includes a pair of side walls 28 and a front wall 27. The second device frame 26 includes a rear wall 29. The side walls 28 in pair are disposed on one longitudinal end side (i.e., axial end side) and another longitudinal end side of the fixing belt 20, respectively. The side walls 28 respectively support opposed longitudinal end sides of the heating device 19 and opposed axial end sides of each of the fixing belt 20 and the pressure roller 21. Each of the side walls 28 is provided with a plurality of engaging projections **28*a*. As the engaging projections 28*a* engage respective engaging holes 29*a* penetrating through the rear wall 29, the first device frame 25 is coupled to the second device frame 26**.

Each of the side walls 28 has an insertion recess **28*b* through which, e.g., a rotary shaft of the pressure roller 21 is inserted. The insertion recess 28*b* is open on a rear wall 29 side and closed on the other side. The closed side defines a contact portion. A bearing 30 is disposed at an end of the contact portion to support the rotary shaft of the pressure roller 21. As opposed axial ends of the rotary shaft of the pressure roller 21 are attached to the respective bearings 30, the pressure roller 21 is rotatably supported by the pair of side walls 28**.

A driving force transmission gear 31 serving as a driving force transmitter is disposed on an axial end side of the rotary shaft of the pressure roller 21. In a state in which the pair of side walls 28 supports the pressure roller 21, the driving force transmission gear 31 is exposed outside the side wall 28. Accordingly, when the fixing device 9 is installed in the body 103 of the image forming apparatus 100, the driving force transmission gear 31 is coupled to a gear disposed inside the body 103 to transmit the driving force from the driver. Note that the driving force transmitter that transmits the driving force to the pressure roller 21 may be, e.g., a coupler or pulleys around which a driving force transmission belt is entrained, instead of the driving force transmission gear 31.

Supports 32 in pair (or a pair of supports 32) are disposed at opposed longitudinal ends of the heating device 19, respectively, to support, e.g., the fixing belt 20, the heater holder 23, and the stay 24. Each of the supports 32 includes guide recesses 32*a*. As the guide recesses 32*a* move along edges of the insertion recess 28*b* of the side wall 28, respectively, the support 32 is attached to the side wall 28.

A pair of springs 33 serving as a pair of biasing members is interposed between the pair of supports 32 and the rear wall 29. As the pair of springs 33 biases the stay 24 and the pair of supports 32 toward the pressure roller 21, the fixing belt 20 is pressed against the pressure roller 21 to form the fixing nip N between the fixing belt 20 and the pressure roller 21.

As illustrated in FIG. 4, a hole 29*b* is provided on one longitudinal end side of the rear wall 29 of the second device frame 26. The hole 29*b* serves as a positioner, specifically, a fixing-device positioner that positions a body of the fixing device 9 relative to the body 103 of the image forming apparatus 100. On the other hand, the body 103 of the image forming apparatus 100 is provided with a projection 101 serving as a positioner. As the projection 101 is inserted into the hole 29*b* of the fixing device 9, the projection 101 engages the hole 29*b*, thus positioning the body of the fixing device 9 relative to the body 103 of the image forming apparatus 100 in the longitudinal direction of the fixing belt 20. Note that no positioner is provided on another longitudinal end side of the rear wall 29 opposite the aforementioned longitudinal end side of the rear wall 29 on which the hole 29*b* is provided. Such a configuration does not restrict thermal expansion or shrinkage of the body of the fixing device 9 in the longitudinal direction of the fixing belt 20 caused by changes in temperature.

Figure 5:
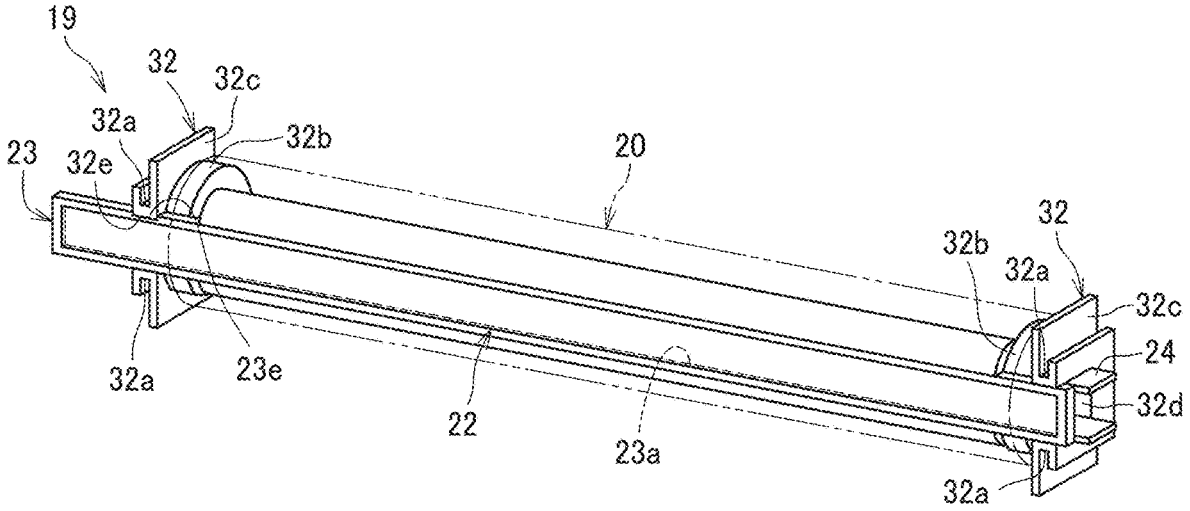
FIG. 5 is a perspective view of a heating device incorporated in the fixing device.
Figure 6:
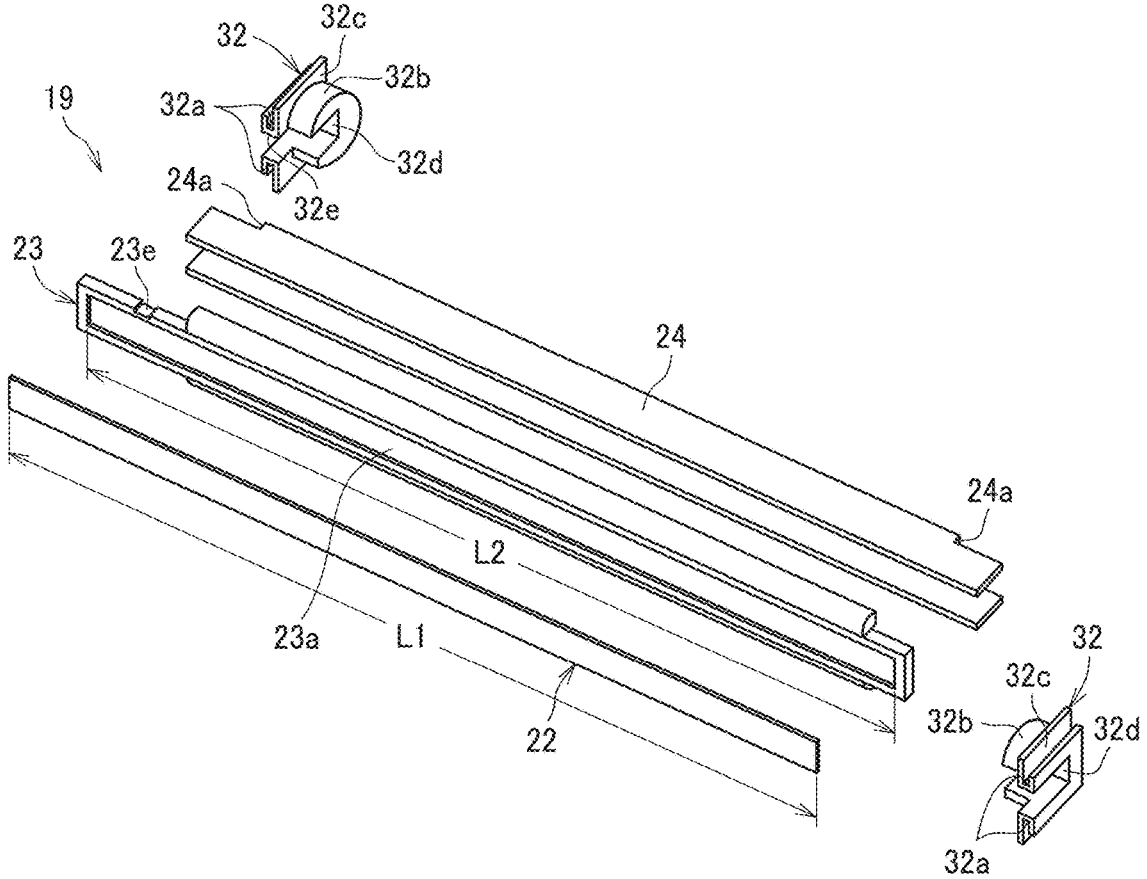
FIG. 6 is an exploded perspective view of the heating device.

Referring now to FIGS. 5 and 6, a detailed description is given of a configuration of the heating device 19 incorporated in the fixing device 9.

FIG. 5 is a perspective view of the heating device 19. FIG. 6 is an exploded perspective view of the heating device 19.

As illustrated in FIGS. 5 and 6, the heater holder 23 includes a rectangular accommodating recess 23*a* on a belt-side surface of the heater holder 23 to accommodate the heater 22. Note that the belt-side surface of the heater holder 23 faces the fixing belt 20 and the fixing nip N. The belt-side surface of the heater holder 23 is a surface on a front side in FIGS. 5 and 6. The accommodating recess 23*a* has substantially the same shape and size as the shape and size of the heater 22. Specifically, however, a length L2 of the accommodating recess 23*a* in the longitudinal direction of the heater holder 23 is slightly greater than a length L1 of the heater 22 in the longitudinal direction of the heater 22. The accommodating recess 23*a* is thus slightly longer than the heater 22. Accordingly, even when the heater 22 extends in the longitudinal direction of the heater 22 due to thermal expansion, the heater 22 does not interfere with the accommodating recess 23*a*. A connector serving as a power supplier sandwiches the heater holder 23 and the heater 22 accommodated in the accommodating recess 23*a*, thus holding the heater 22. A detailed description of the connector is deferred.

Each of the supports 32 in pair includes a C-shaped belt support 32*b*, a belt restrictor 32*c*, and a supporting recess 32*d*. The belt support 32*b* is inserted into the loop formed by the fixing belt 20 to support the fixing belt 20. The belt restrictor 32*c* is a flange that contacts an edge surface of the fixing belt 20 to restrict a longitudinal movement (e.g., skew) of the fixing belt 20. The supporting recess 32*d* supports the heater holder 23 and the stay 24 with one longitudinal end side of each of the heater holder 23 and the stay 24 inserted into the supporting recess 32*d*. As the belt support 32*b* is inserted into the loop formed by the fixing belt 20 on each axial end side of the fixing belt 20, the fixing belt 20 is supported by a free belt system in which the fixing belt 20 is not stretched basically in a circumferential direction of the fixing belt 20, which is a rotation direction of the fixing belt 20, while the fixing belt 20 does not rotate.

As illustrated in FIGS. 5 and 6, a positioning recess 23*e* serving as a positioner is provided on one longitudinal end side of the heater holder 23. An engagement 32*e* of the support 32 illustrated on the left side in FIGS. 5 and 6 engages the positioning recess 23*e*, thus positioning the heater holder 23 relative to the support 32 in the longitudinal direction of the fixing belt 20. By contrast, the support 32 illustrated on the right side in FIGS. 5 and 6 does not include the engagement 32*e*. Therefore, the heater holder 23 is not positioned relative to the support 32 in the longitudinal direction of the fixing belt 20. The heater holder 23 is thus positioned relative to the support 32 on a single side in the longitudinal direction of the fixing belt 20. Such a configuration does not restrict thermal expansion or shrinkage of the heater holder 23 in the longitudinal direction of the fixing belt 20 caused by changes in temperature.

As illustrated in FIG. 6, a step 24*a* is provided on each longitudinal end side of the stay 24 to restrict movement of the stay 24 relative to the support 32. Specifically, the step 24*a* comes into contact with the support 32, thus restricting a longitudinal movement of the stay 24 relative to the support 32. Note that at least one of the steps 24*a* is arranged relative to the support 32 via a gap. Such an arrangement does not restrict thermal expansion or shrinkage of the stay 24 in the longitudinal direction of the fixing belt 20 caused by changes in temperature.

Figure 7:
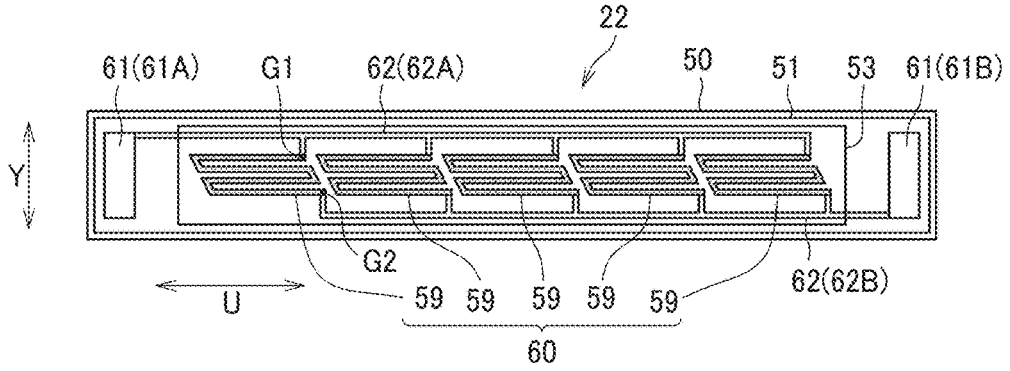
FIG. 7 is a plan view of a heater incorporated in the heating device.
Figure 8:
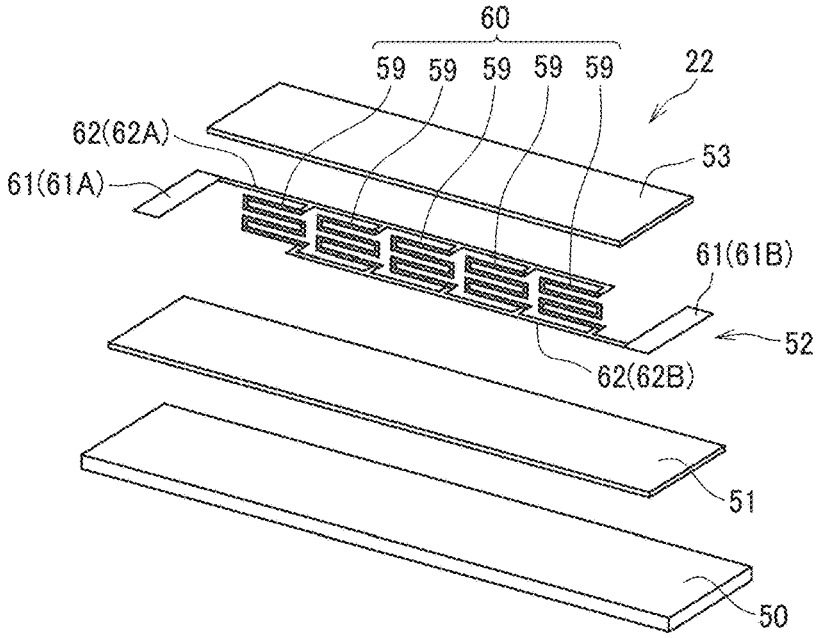
FIG. 8 is an exploded perspective view of the heater.

Referring now to FIGS. 7 and 8, a detailed description is given of a configuration of the heater 22 incorporated in the heating device 19.

FIG. 7 is a plan view of the heater 22. FIG. 8 is an exploded perspective view of the heater 22.

As illustrated in FIG. 8, the heater 22 includes the base 50, the first insulation layer 51 disposed on the base 50, the conductor layer 52 disposed on the first insulation layer 51, and the second insulation layer 53 that covers the conductor layer 52.

The base 50 is an elongated plate made of metal such as stainless steel (e.g., SUS), iron, or aluminum. The base 50 may be made of ceramic or glass instead of metal. In a case in which the base 50 is made of an insulating material such as ceramic, the first insulation layer 51 sandwiched between the base 50 and the conductor layer 52 may be omitted. Since metal has an enhanced durability against rapid heating and is easy to process, metal is preferably used to reduce manufacturing costs. Among metals, aluminum and copper are preferable because aluminum and copper especially attain an increased thermal conductivity and barely suffer from unevenness in temperature. Stainless steel is advantageous because stainless steel is manufacturable at reduced costs compared to aluminum and copper.

Each of the first insulation layer 51 and the second insulation layer 53 is made of a material having insulating properties such as heat resistant glass. Alternatively, each of the first insulation layer 51 and the second insulation layer 53 may be made of, e.g., ceramic or PI.

The conductor layer 52 includes the heat generation unit 60, a plurality of electrodes 61, and a plurality of feed lines 62. The heat generation unit 60 includes resistive heat generators 59 arranged in the longitudinal direction of the heater 22. The plurality of feed lines 62 serves as a plurality of conductors that electrically connects the heat generation unit 60 and the plurality of electrodes 61. In the present embodiment, the plurality of electrodes 61 includes a first electrode 61A and a second electrode 61B. The first electrode 61A and the second electrode 61B are arranged on opposed longitudinal end sides of the base 50. The "end side" herein refers to one or another longitudinal end side of the base 50 rather than the heat generation unit 60. The resistive heat generators 59 are arranged in a line in a longitudinal direction of the base 50 between the first electrode 61A and the second electrode 61B. In FIG. 7, a "transverse direction" is a direction indicated by arrow Y intersecting the longitudinal direction (i.e., longitudinal direction U) of the heater 22 (or the base 50) along a surface of the heater 22 on which the heat generation unit 60 is disposed. Hereinafter, the transverse direction is occasionally referred to as a transverse direction Y. When viewed in the transverse direction Y, each of the resistive heat generators 59 is interposed between a first feed line 62A serving as a first conductor and a second feed line 62B serving as a second conductor that extend in the longitudinal direction U of the heater 22. In the present embodiment, each of the resistive heat generators 59 is shaped to reciprocate (or to be folded back) in the longitudinal direction U of the heater 22 via corner portions. A first end portion of each of the resistive heat generators 59 in the transverse direction Y of the heater 22 is connected to the first electrode 61A through the first feed line 62A. In other words, the first feed line 62A is connected to the first end portion of each of the resistive heat generators 59 in the transverse direction Y of the heater 22 at a connecting position G1. A second end portion of each of the resistive heat generators 59 in the transverse direction Y of the heater 22 is connected to the second electrode 61B through the second feed line 62B. In other words, the second feed line 62B is connected to the second end portion of each of the resistive heat generators 59 in the transverse direction Y of the heater 22 at a connecting position G2. Thus, the resistive heat generators 59 are connected in parallel with each other to the first electrode 61A and the second electrode 61B through the first feed line 62A and the second feed line 62B, respectively. In other words, the first feed line 62A serving as a first conductor is configured to connect the resistive heat generators 59 in parallel with each other to the first electrode 61A. The second feed line 62B serving as a second conductor is configured to connect the resistive heat generators 59 in parallel with each other to the second electrode 61B.

The resistive heat generators 59 are conductive parts having a resistance value greater than a resistance value of the feed lines 62. The resistive heat generators 59 are formed by, for example, coating the base 50 with a paste of silver-palladium (AgPd), glass powder, and the like by screen printing and thereafter firing the coated base 50. Alternatively, the resistive heat generators 59 may be made of a resistive material such as a silver alloy (AgPt) or ruthenium oxide ($RuO_2$).

The feed lines 62 are conductors having a resistance value smaller than the resistance value of the resistive heat generators 59. The feed lines 62 and the electrodes 61 are made of, e.g., silver (Ag) or AgPd. The feed lines 62 and the electrodes 61 are formed by screen printing of such a material, for example.

Figure 9:
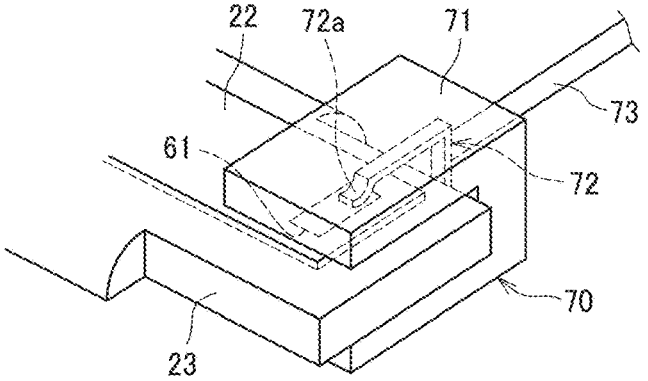
FIG. 9 is a perspective view of the heater and a connector coupled to the heater.

Referring now to FIG. 9, a description is given of a connector 70 that is coupled to the heater 22.

FIG. 9 is a perspective view of the heater 22 and the connector 70 coupled to the heater 22.

As illustrated in FIG. 9, the connector 70 includes a housing 71 made of resin and a contact terminal 72 disposed in the housing 71. The contact terminal 72 is a flat spring and coupled to a harness 73 that supplies power.

As illustrated in FIG. 9, the connector 70 is attached to the heater 22 and the heater holder 23 such that a front side of the connector 70 sandwiches the heater 22 and the heater holder 23 together with a back side of the connector 70. In this state, a contact 72*a* provided at an end of the contact terminal 72 resiliently contacts or presses against the electrode 61. Accordingly, the heat generation unit 60 is electrically connected to a power supply disposed in the image forming apparatus 100 through the connector 70, allowing the power supply to supply power to the heat generation unit 60. Similarly, another connector 70 is connected to the electrode 61 located opposite the electrode 61 illustrated in FIG. 9 in the longitudinal direction of the heater 22. Note that, as illustrated in FIG. 7, at least part of each of the electrodes 61 is not coated by the second insulation layer 53 and therefore exposed to secure connection with the corresponding connector 70.

In a typical heater including a base provided with a feed line, when power is supplied from a power supply to a resistive heat generator so that the resistive heat generator generates heat, the feed line is energized and generates heat. Such heat generation of the feed line affects a temperature distribution of the entire heater. However, the influences are changeable. The influences change depending on, e.g., the layout of the feed line or the connecting position of the feed line and the resistive heat generator.

Referring now to FIGS. 10A to 11B, a description is given of different influences of heat generation of the feed line, caused by different connecting positions of the feed line and the resistive heat generator.

Figure 10A:
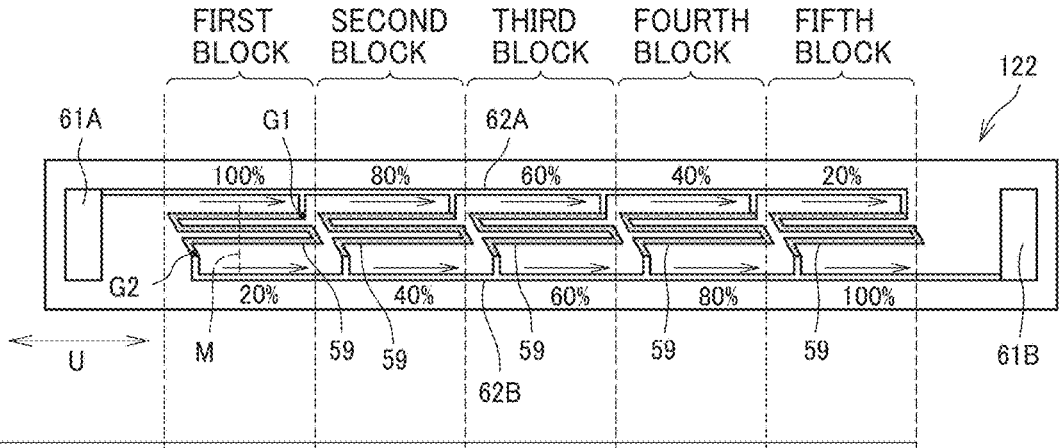
FIG. 10A is a plan view of a comparative heater, illustrating feed lines connected to each resistive heat generator on opposite sides of each resistive heat generator in a longitudinal direction of the comparative heater, with a table indicating the amounts of heat generated by the feed lines for each block.
Figure 10B:
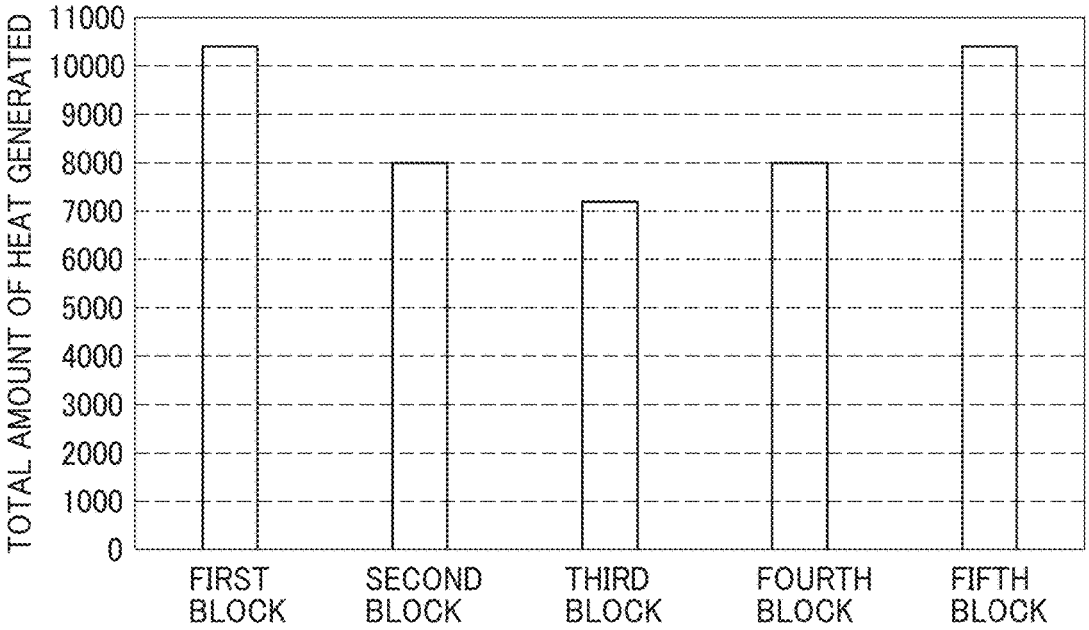
FIG. 10B is a graph illustrating the total amount of heat generated by the feed lines for each block.

FIG. 10A illustrates a comparative heater 122 having a configuration different from the configuration of the aforementioned heater 22 according to an embodiment of the present disclosure. Specifically, FIG. 10A is a plan view of the comparative heater 122, illustrating the feed lines 62 connected to each of the resistive heat generators 59 on opposite sides of each of the resistive heat generators 59 in a longitudinal direction of the comparative heater 122, with a table indicating the amounts of heat generated by the feed lines 62 for each block. FIG. 10B is a graph illustrating the total amount of heat generated by the feed lines for each block.

The first feed line 62A and the second feed line 62B are connected to each of the resistive heat generators 59 at the connecting positions G1 and G2, respectively. The connecting positions G1 and G2 are located on opposite sides (i.e., right side and left side in FIG. 10A) with respect to a center M of each of the resistive heat generators 59 in the longitudinal direction U of the comparative heater 122.

Figure 11A:
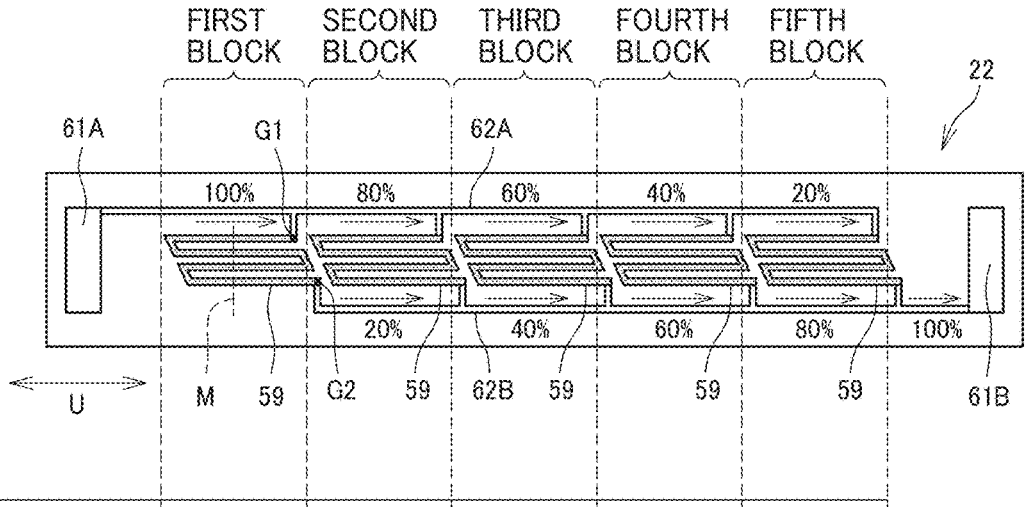
FIG. 11A is a plan view of the heater of FIG. 7, illustrating feed lines connected to each resistive heat generator on one side of each resistive heat generator in a longitudinal direction of the heater, with a table indicating the amounts of heat generated by the feed lines for each block.
Figure 11B:
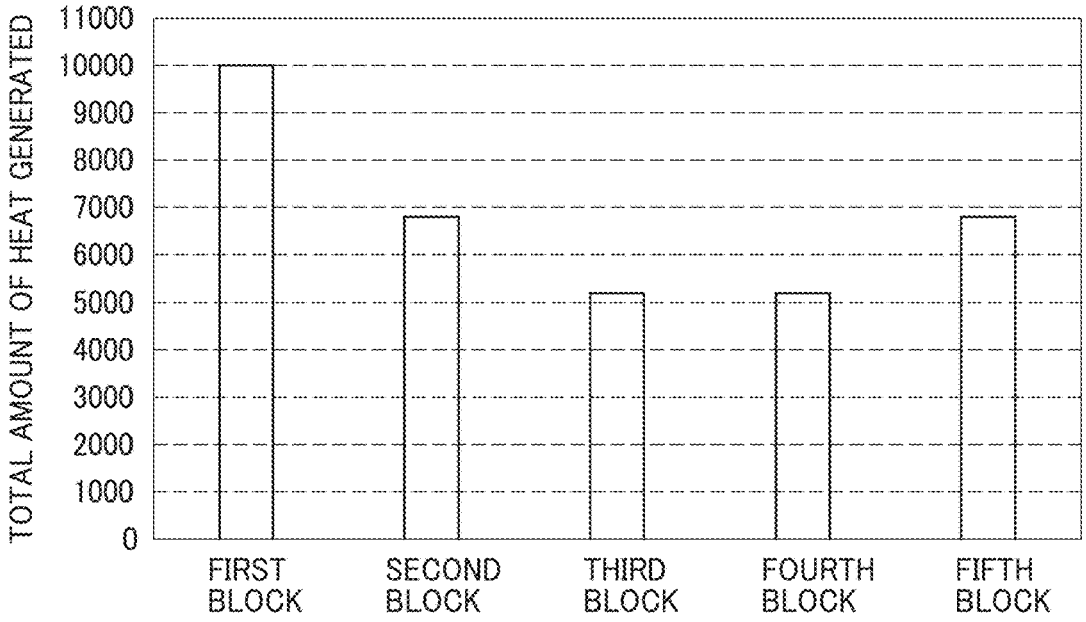
FIG. 11B is a graph illustrating the total amount of heat generated by the feed lines for each block.

By contrast, FIG. 11A illustrates the heater 22 according to an embodiment of the present disclosure. Specifically, FIG. 11A is a plan view of the heater 22 of FIG. 7, illustrating the feed lines 62 connected to each of the resistive heat generators 59 on one side of each of the resistive heat generators 59 in the longitudinal direction of the heater 22, with a table indicating the amounts of heat generated by the feed lines 62 for each block. FIG. 11B is a graph illustrating the total amount of heat generated by the feed lines 62 for each block.

The first feed line 62A and the second feed line 62B are connected to each of the resistive heat generators 59 at the connecting positions G1 and G2, respectively. The connecting positions G1 and G2 are located on the same side (in this case, right side in FIG. 11A) with respect to the center M of each of the resistive heat generators 59 in the longitudinal direction U of the heater 22.

In the examples illustrated in FIGS. 10A and 11A, when the current flows to each of the resistive heat generators 59 by 20%, the amounts of heat generated by the feed lines 62 for each of first to fifth blocks corresponding to each of the resistive heat generators 59 are as indicated by the tables illustrated in FIGS. 10A and 11A, respectively.

Since a relatively small amount of heat is generated in a shorter portion of each of the feed lines 62 extending in a transverse direction of the comparative heater 122 and the heater 22, the respective tables illustrated in FIGS. 10A and 11A simply indicate the calculated amounts of heat generated in a longer portion of each of the feed lines 62 extending in the longitudinal direction U of the comparative heater 122 and the heater 22, excluding the amount of heat generated in the shorter portion. Specifically, in FIG. 10A, calculated is the amount of heat generated in the longer portion of each of the first feed line 62A located on an upper side in FIG. 10A and the second feed line 62B located on a lower side in FIG. 10A extending in the longitudinal direction U of the comparative heater 122. In FIG. 11A, calculated is the amount of heat generated in the longer portion of each of the first feed line 62A located on an upper side in FIG. 11A and the second feed line 62B located on a lower side in FIG. 11A extending in the longitudinal direction U of the heater 22. Since a heat generation amount (W) is represented by the following equation (1), the heat generation amount indicated in each of the tables of FIGS. 10A and 11A is calculated as the square of a current (I) flowing through each of the feed lines 62 for convenience. Therefore, the numerical values of the heat generation amount indicated in each of the tables of FIGS. 10A and 11A are merely values calculated simply and may be different from the actual heat generation amount.

$$W=R\times I^2, \tag{1}$$

where W represents the heat generation amount, R represents the resistance, and I represents the current.

With continued reference to FIG. 10A, a description is given a specific way of calculating the heat generation amount for the first and second blocks, for example. In the first block of FIG. 10A, the current flowing through the first feed line 62A is 100% while the current flowing through the second feed line 62B is 20%. Therefore, the total amount of heat generated by the feed lines 62 in the first block is 10400, which is the total value of the square of 100 (i.e., 10000) and the square of 20 (i.e., 400). In the second block of FIG. 10A, the current flowing through the first feed line 62A is 80% while the current flowing through the second feed line 62B is 40%. Therefore, the total amount of heat generated by the feed lines 62 in the second block is 8000, which is the total value of the square of 80 (i.e., 6400) and the square of 40 (i.e., 1600).

The heat generation amounts are calculated similarly for the other blocks.

FIGS. 10B and 11B are graphs of the tables of FIGS. 10A and 11A, respectively, illustrating the total amount of heat generated by the feed lines 62, in the vertical axis, for each of the first to fifth blocks. As is clear from the graph of FIG. 10B, in a case in which the first feed line 62A and the second feed line 62B are connected to each of the resistive heat generators 59 at the connecting positions G1 and G2, respectively, on the opposite sides in the longitudinal direction U of the comparative heater 122, the total heat generation amounts for the first to fifth blocks are symmetric with respect to the third block located in a center of a heat generation span. By contrast, as is clear from the graph of FIG. 11B, in a case in which the first feed line 62A and the second feed line 62B are connected to each of the resistive heat generators 59 at the connecting positions G1 and G2, respectively, on the same side in the longitudinal direction U of the heater 22, the total heat generation amounts for the first to fifth blocks are asymmetric with respect to the third block located in the center of the heat generation span.

In short, depending on whether the connecting positions G1 and G2 are located on different sides or the same side in the longitudinal direction U, the total heat generation amounts of the feed lines 62 are symmetric on the one hand and asymmetric on the other hand. As in the example illustrated in FIG. 10B, in a case in which the amounts of heat generated by the feed lines 62 are symmetric, the temperature distribution of the comparative heater 122 is not asymmetric even when the influence of heat generation of the feed lines 62 affects the temperature distribution of the entire comparative heater 122. By contrast, in a case in which the amounts of heat generated by the feed lines 62 are asymmetric as in the example illustrated in FIG. 11B, the temperature distribution of the heater 22 may be asymmetric due to the influence of heat generation of the feed lines 62. In particular, in a case in which the current flowing to resistive heat generators is increased to speed up an image forming apparatus, or in a case in which feed lines are thinned to downsize a heater in a transverse direction of the heater, the amount of heat generated by the feed lines increases. Therefore, a longitudinal unevenness in temperature (or unevenness in temperature distribution) of the heater becomes remarkable. An increased longitudinal unevenness in temperature of the heater causes unevenness in glossiness in a fixed image, leading to a deterioration in image quality. In addition to the aforementioned case in which the connecting positions G1 and G2 of all the resistive heat generators 59 and the first feed line 62A and the second feed line 62B, respectively, are located on the same side in the longitudinal direction U of the heater 22, the amounts of heat generated by the feed lines 62 become asymmetric in a case in which the connecting positions G1 and G2 of at least one of the resistive heat generators 59 and the first feed line 62A and the second feed line 62B, respectively, are located on the same side in the longitudinal direction U of the heater 22.

To prevent such a longitudinal unevenness in temperature of a heater, the following measures are taken in the present embodiment.

Figure 12:
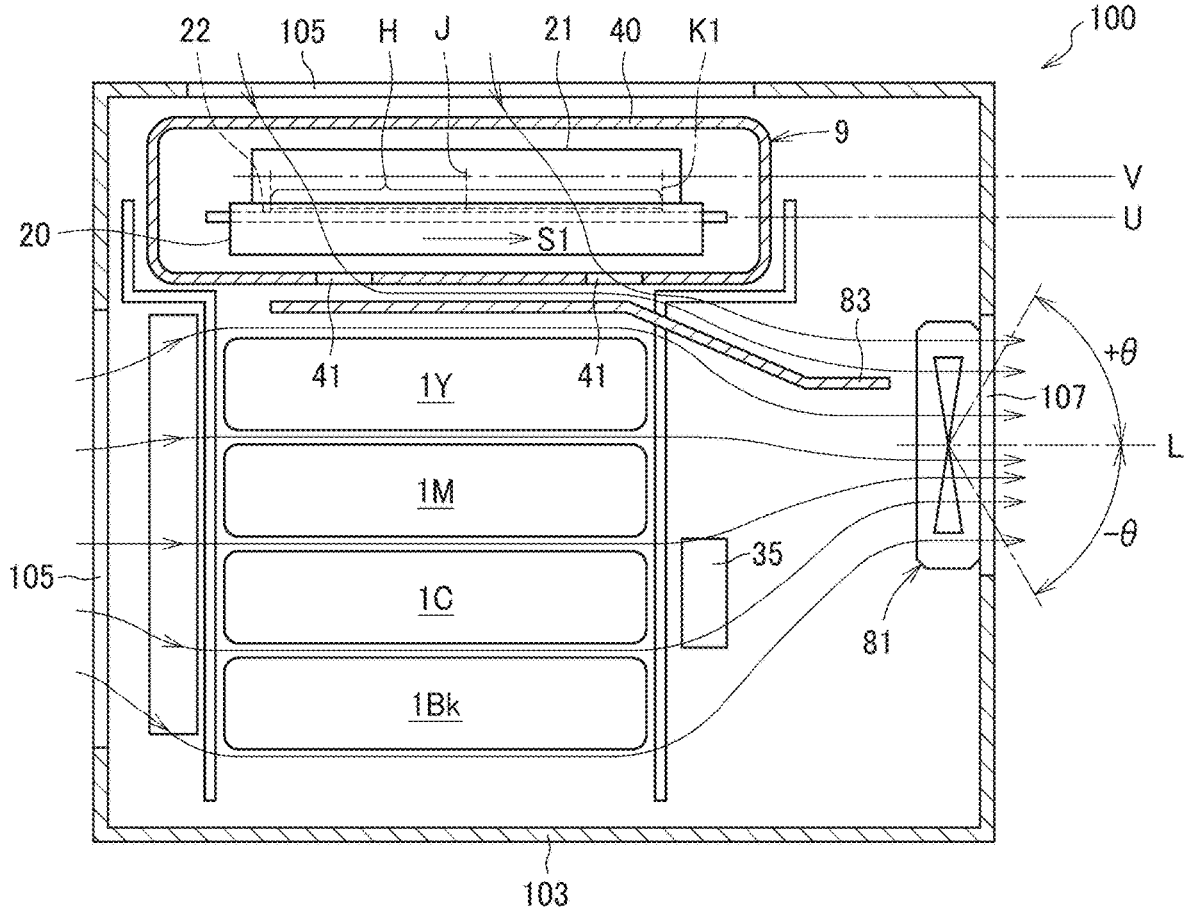
FIG. 12 is a cross-sectional plan view of the image forming apparatus.

FIG. 12 is a cross-sectional plan view of the image forming apparatus 100.

As illustrated in FIG. 12, an airflow generator is disposed in the image forming apparatus 100, as a cooler that cools the fixing device 9. The airflow generator in the present embodiment is an exhaust fan 81 that discharges air out of the body 103 of the image forming apparatus 100. In the present embodiment, intake ports 105 are provided on an upper side wall and a left side wall, respectively, of the body 103 in FIG. 12. An exhaust port 107 is provided on a right side wall of the body 103 in FIG. 12. The exhaust fan 81 is disposed closer to the exhaust port 107 than the fixing device 9. In other words, the exhaust fan 81 is disposed closer to the exhaust port 107 than the heater 22. When the exhaust fan 81 is driven, the outside air is sucked or taken in through the intake ports 105 and then discharged out through the exhaust port 107. That is, the driven exhaust fan 81 generates an airflow from the intake ports 105 to the exhaust port 107 in the body 103 of the image forming apparatus 100.

In addition, as illustrated in FIG. 12, the device frame 40 of the fixing device 9 includes a plurality of ventilation holes 41. Therefore, the air mainly taken in through the intake port 105 on the upper side in FIG. 12 passes through the ventilation holes 41 of the fixing device 9 and is discharged through the exhaust port 107. Note that the ventilation holes 41 are open for ventilation and different from openings (namely, a sheet entrance and a sheet exit) through which the sheets P are conveyed and the holes into which positioning projections or bolts are inserted to attach the fixing device 9 to the body 103 of the image forming apparatus 100. Further, in the present embodiment, a duct 83 is disposed between the ventilation holes 41 and the exhaust fan 81, as a ventilation channel that guides an airflow from the ventilation holes 41 to the exhaust fan 81.

As the air taken in through the intake ports 105 is susceptible to a heat source of, e.g., the fixing device 9 and increases in temperature while passing through the inside of the body 103 of the image forming apparatus 100. Therefore, in general, the air discharged through the exhaust port 107 is higher in temperature than the air taken in through the intake ports 105. In other words, the air taken in through the intake ports 105 is lower in temperature than the air discharged through the exhaust port 107. In short, a cooling ability with the airflow to a side on which the air is taken in from the outside is greater than the cooling ability to a side on which the air is discharged to the outside.

Therefore, the longitudinal unevenness in temperature of the heater 22 is prevented by location of a longitudinal end side higher in temperature of the heater 22 on the side on which the cooling ability with the airflow is greater. For example, in regard to the aforementioned heater 22 illustrated in FIG. 11A, the temperature is higher on a left end side of the heater 22 than the temperature on a right end side of the heater 22. Therefore, the exhaust fan 81, which is an airflow generator serving as a cooler, generates an airflow to the heater 22 left to right in FIG. 11A or FIG. 12, that is, from the left end side of the heater 22 higher in temperature to the right end side of the heater 22 lower in temperature. In other words, in FIG. 11A or FIG. 12, the left end side of the heater 22 higher in temperature is located on an upstream side of the airflow; whereas the right end side of the heater 22 lower in temperature is located on a downstream side of the airflow.

Figure 13A:
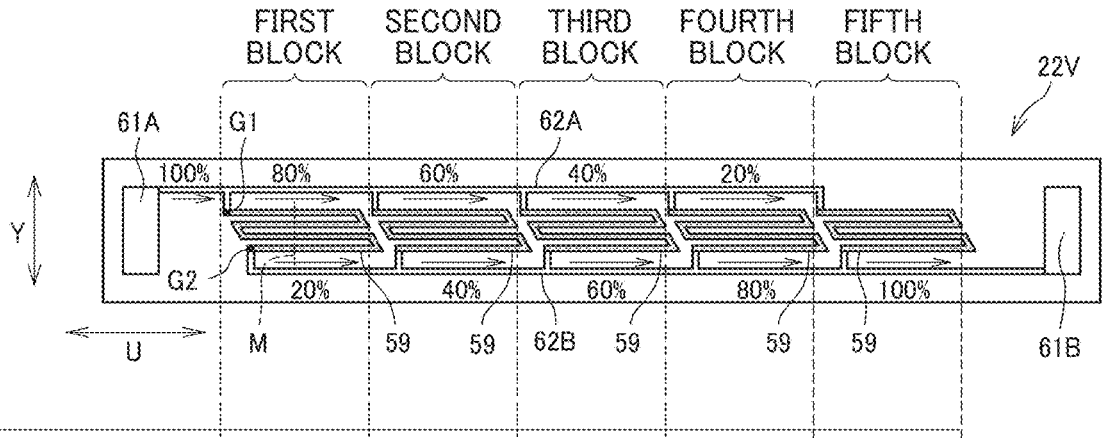
FIG. 13A is a plan view of a variation of the heater of FIG. 11A, illustrating the feed lines connected to each resistive heat generator on another side of each resistive heat generator in a longitudinal direction of the variation of the heater, with a table indicating the amounts of heat generated by the feed lines for each block.
Figure 13B:
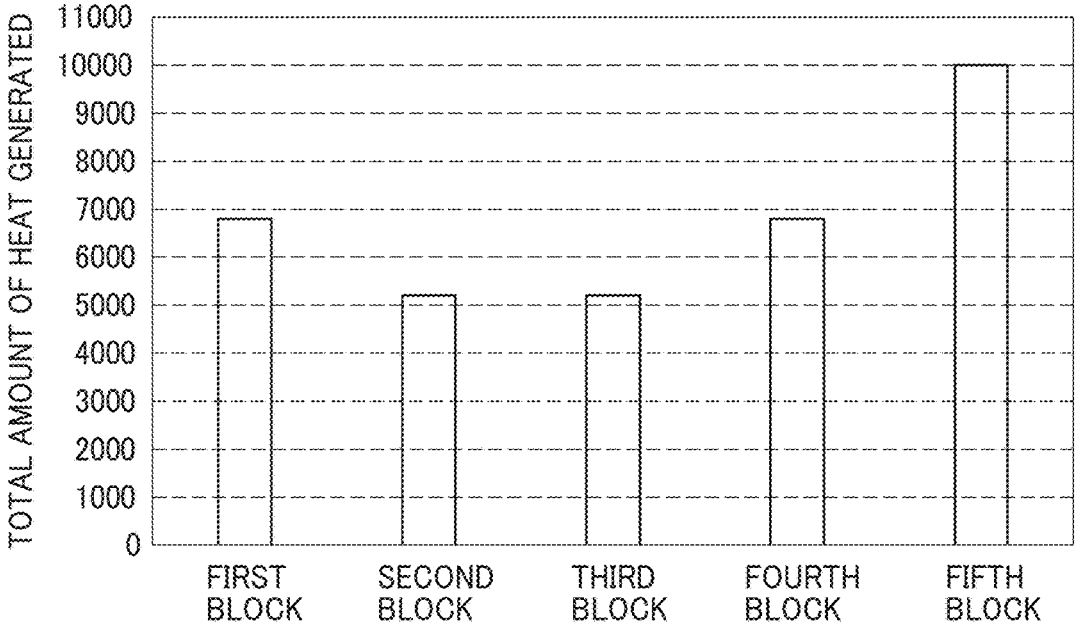
FIG. 13B is a graph illustrating the total amount of heat generated by the feed lines for each block.

Referring now to FIGS. 13A and 13B, a description is given of a configuration of a heater 22V as a variation of the heater 22 illustrated in FIG. 11A.

FIG. 13A is a plan view of the heater 22V, illustrating the feed lines 62 connected to each of the resistive heat generators 59 on another side of each of the resistive heat generators 59, opposite the aforementioned side of each of the resistive heat generators 59 illustrated in FIG. 11A, in a longitudinal direction of the heater 22V, with a table indicating the amounts of heat generated by the feed lines 62 for each block. FIG. 13B is a graph illustrating the total amount of heat generated by the feed lines 62 for each block.

FIGS. 13A and 13B illustrate an example opposite the example illustrated in FIGS. 11A and 11B in the location of the connecting positions G1 and G2. Specifically, in FIG. 13A, the first feed line 62A and the second feed line 62B are connected to each of the resistive heat generators 59 on the left side with respect to the center M of the resistive heat generator 59 in the longitudinal direction U of the heater 22V. That is, a longitudinal end side higher in temperature (i.e., higher-temperature side) of the heater 22V is opposite the longitudinal end side higher in temperature (i.e., higher-temperature side) of the heater 22. That is, in this case, the temperature is higher on a right end side of the heater 22V than the temperature on a left end side of the heater 22V in FIG. 13A. Therefore, contrary to the example illustrated in FIG. 11A, the exhaust fan 81 generates an airflow to the heater 22V right to left in FIG. 13A, that is, from the right end side of the heater 22V to the left end side of the heater 22V. In other words, in FIG. 13A, the right end side of the heater 22V higher in temperature is located on an upstream side of the airflow; whereas the left end side of the heater 22V lower in temperature is located on a downstream side of the airflow.

In short, in a case in which the first feed line 62A and the second feed line 62B are connected to the resistive heat generator 59 on one longitudinal end side (herein serving as a first longitudinal end side) of the heater 22 from the center M of the resistive heat generator 59 in the longitudinal direction U of the heater 22, the temperature is higher on another longitudinal end side (herein serving as a second longitudinal end side) of the heater 22 opposite the first longitudinal end side of the heater 22 than the temperature on the first longitudinal end side of the heater 22. Therefore, a cooling ability of the cooler to the second longitudinal end side higher in temperature (i.e., higher-temperature side) of the heater 22 is greater than the cooling ability to the first longitudinal end side lower in temperature (i.e., lower-temperature side) of the heater 22. Note that the "one end" or "one end portion" herein refers to any one of the opposed longitudinal end portions of the heater 22.

As described above, the present embodiment enhances the cooling ability to the higher-temperature side of the heater 22, thus preventing the longitudinal unevenness in temperature of the heater 22 and the fixing belt 20. Accordingly, the present embodiment prevents defects such as the unevenness in glossiness, thus maintaining the image quality.

In order to effectively generate the airflow and enhance the cooling ability, as illustrated in FIG. 12, the exhaust fan 81 is preferably disposed on a side closer to the exhaust port 107 from a center J of a heat generation span H, which is a longitudinal span of the heater 22 over which all the resistive heat generators 59 are disposed. In other words, the exhaust fan 81 is preferably disposed on a side in a first direction S1 from the center J of the heat generation span H. Note that the first direction S1 is a direction indicated by arrow S1 from the left end side of the heater 22 higher in temperature to the right end side of the heater 22 lower in temperature in FIG. 12. More preferably, the exhaust fan 81 is disposed on the side in the first direction S1 from an end portion K1 of the heat generation span H in the first direction S1.

In the image forming apparatus 100 having a layout as illustrated in FIG. 12, an axial direction L of the exhaust fan 81 is parallel to the longitudinal direction U of the heater 22 or an axial direction V of the pressure roller 21 such that the exhaust fan 81 is disposed on or near an inner surface of the side wall provided with the exhaust port 107 to facilitate discharging of air through the exhaust port 107.

In a case in which the exhaust fan 81 is hardly disposed such that the axial direction L of the exhaust fan 81 is parallel to the longitudinal direction U of the heater 22 or the axial direction V of the pressure roller 21 due to layout reasons, the axial direction L of the exhaust fan 81 may be inclined at an angle of $\pm\theta°$ with respect to the longitudinal direction U of the heater 22 or the axial direction V of the pressure roller 21. However, if the inclination angle $\theta$ of the exhaust fan 81 is too large, the exhaust fan 81 might have difficulties in discharging the air through the exhaust port 107. To address such a situation, the inclination angle θ of the exhaust fan 81 is preferably within a range of ±60° (i.e., −60°≤θ≤+60°) with respect to the longitudinal direction U of the heater 22 or the axial direction V of the pressure roller 21. More preferably, the inclination angle θ of the exhaust fan 81 is within a range of ±45° (i.e., −45°≤θ≤+45°) with respect to the longitudinal direction U of the heater 22 or the axial direction V of the pressure roller 21, and even more preferably within a range of ±30° (i.e., −30°≤θ≤+30°) with respect to the longitudinal direction U of the heater 22 or the axial direction V of the pressure roller 21.

Further, as illustrated in FIG. 12, in the present embodiment, a space in which the exhaust fan 81 is disposed is communicated with a space in which a motor 35 is disposed as a drive source of each of the image forming units 1Y, 1M, 1C, and 1Bk. Accordingly, the exhaust fan 81 generates an airflow around the fixing device 9, and also around the motor 35 for each of the image forming units 1Y, 1M, 1C, and 1Bk. As described above, the exhaust fan 81 that cools the fixing device 9 generates an airflow around another object to be cooled such as the motor 35 for each of the image forming units 1Y, 1M, 1C, and 1Bk, a power supply board, the developing device 4, or the exposure device 6. Accordingly, a dedicated exhaust fan is excludable for each object to be cooled. Thus, the image forming apparatus 100 is downsized and manufactured at reduced costs.

As illustrated in FIG. 12, the ventilation holes 41 are preferably located on a side closer to the fixing belt 20 to a side closer to the pressure roller 21, in the device frame 40 of the fixing device 9. In other words, the ventilation holes 41 are preferably located closer to the fixing belt 20 than to the pressure roller 21. Such a location effectively generates an airflow on the side closer to the fixing belt 20 on which the temperature is desirably equalized particularly in the longitudinal direction of the heater 22, thus preventing the longitudinal unevenness in temperature of the heater 22 described above.

Figure 14:
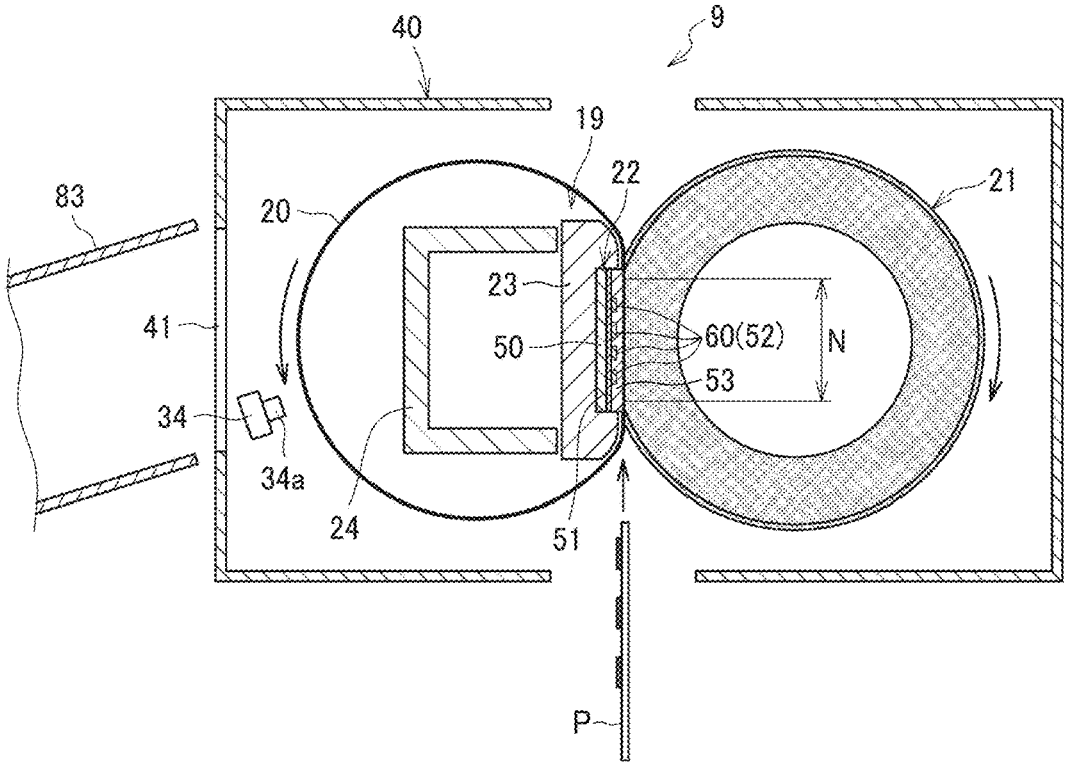
FIG. 14 is a cross-sectional side view of the fixing device, illustrating a first example of location of a temperature sensor.

FIG. 14 is a cross-sectional side view of the fixing device 9, illustrating a first example of location of a temperature sensor 34.

As illustrated in FIG. 14, the image forming apparatus 100 includes the temperature sensor 34 disposed at a position corresponding to (or opposite) the ventilation hole 41, as a belt temperature detector that detects a temperature of the fixing belt 20. Such a location of the temperature sensor 34 attains advantages described below. Note that the temperature sensor 34 may be either a non-contact sensor or a contact sensor.

In the fixing device 9, as the sheet P is heated when passing through the fixing nip N, the water contained in the sheet P is released as water vapor. At this time, the water vapor adhering to a temperature detection part 34*a* of the temperature sensor 34 as water droplets may cause a temperature detection error. To address such a situation, the temperature sensor 34 is disposed opposite the ventilation hole 41 as in the example illustrated in FIG. 14. Such a location of the temperature sensor 34 facilitates generation of an airflow around the temperature sensor 34 and prevents the water droplets from adhering to the temperature detection part 34*a*. Accordingly, the temperature detection error is less likely to occur. As the water droplets are prevented from adhering to the temperature detection part 34*a*, the temperature sensor 34 can be disposed at a position at which water droplets are likely to adhere to the temperature sensor 34. Thus, the present embodiment enhances the layout flexibility. In addition, as the temperature sensor 34, an inexpensive infrared temperature sensor of which the temperature detection accuracy is likely to decrease due to the attachment of water droplets is adoptable to reduce manufacturing costs. Examples of the inexpensive infrared temperature sensor include a non-contact (NC) sensor and a thermopile.

Figure 15:
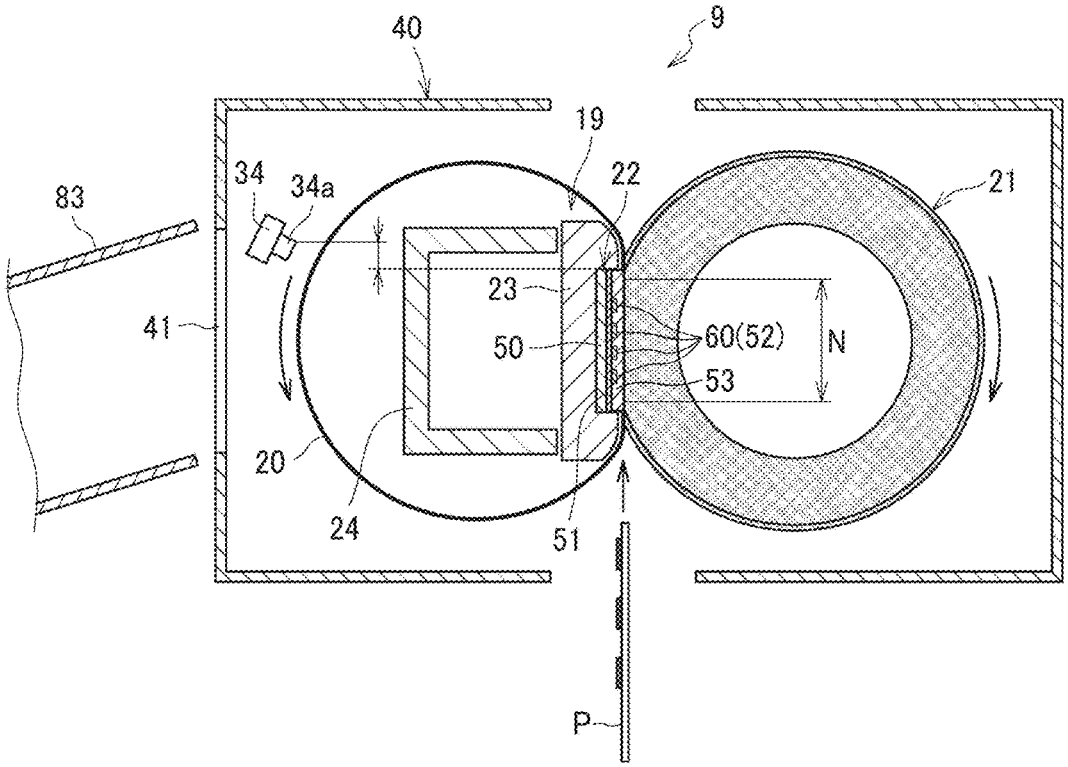
FIG. 15 is another cross-sectional side view of the fixing device, illustrating a second example of location of the temperature sensor.

FIG. 15 is another cross-sectional side view of the fixing device 9, illustrating a second example of location of the temperature sensor 34.

Since the water droplets hardly adhere to the temperature sensor 34, the temperature sensor 34 may be disposed at a position above the heater 22 in a gravity direction at which the temperature sensor 34 is susceptible to water vapor as illustrated in FIG. 15. That is, even in a case in which an upper end of the temperature detection part 34*a* is located above an upper end of the heater 22 in the gravity direction, the temperature sensor 34 detects the temperature of the fixing belt 20 with accuracy provided that the temperature sensor 34 is disposed at a position corresponding to (or opposite) the ventilation hole 41. In other words, the temperature sensor 34 disposed at such a position detects the temperature of the fixing belt 20 on an exit side of the fixing nip N at which the temperature increases. In short, the temperature sensor 34 detects a temperature rise of the fixing belt 20 with an enhanced accuracy.

Figure 16:
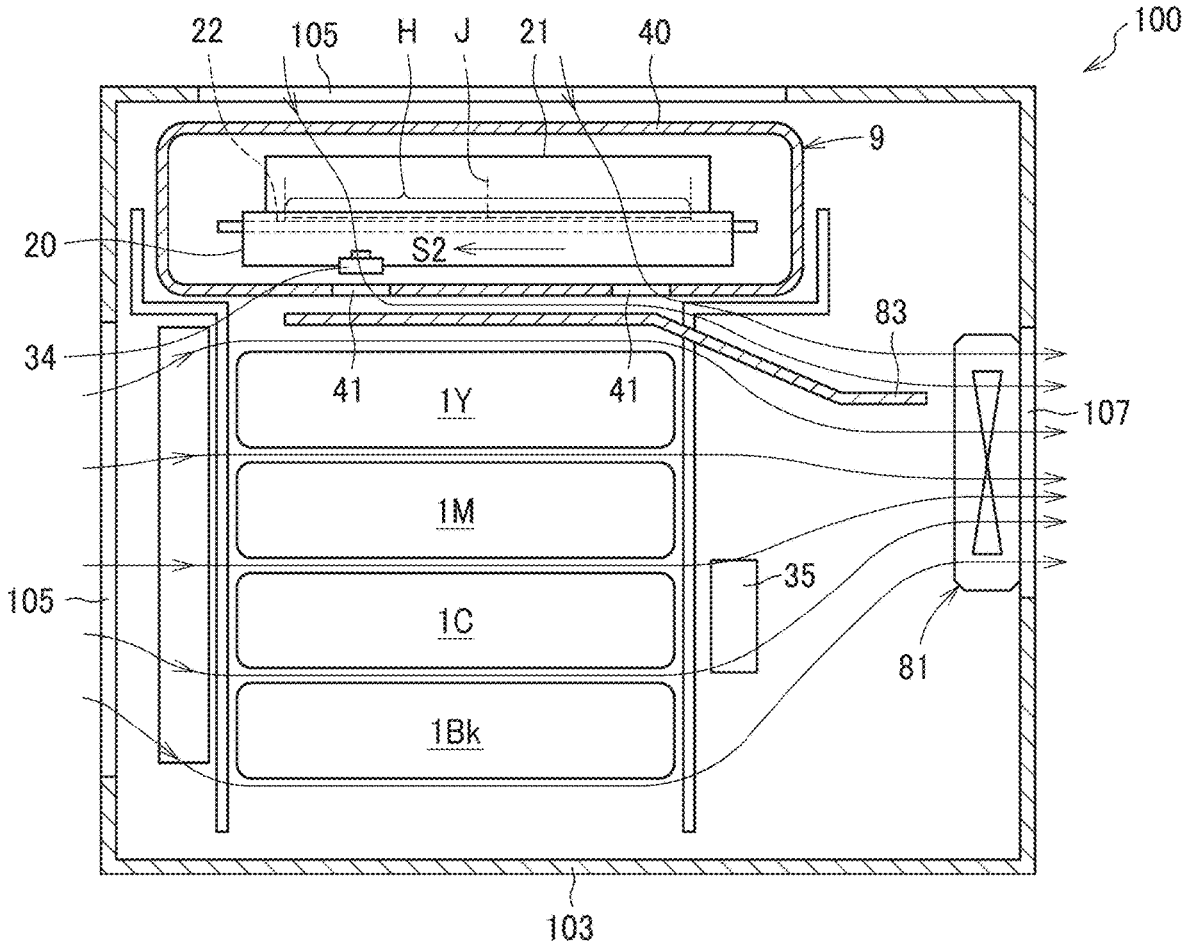
FIG. 16 is a cross-sectional plan view of the image forming apparatus, illustrating a first example of location of the temperature sensor in the longitudinal direction of the heater.
Figure 17:
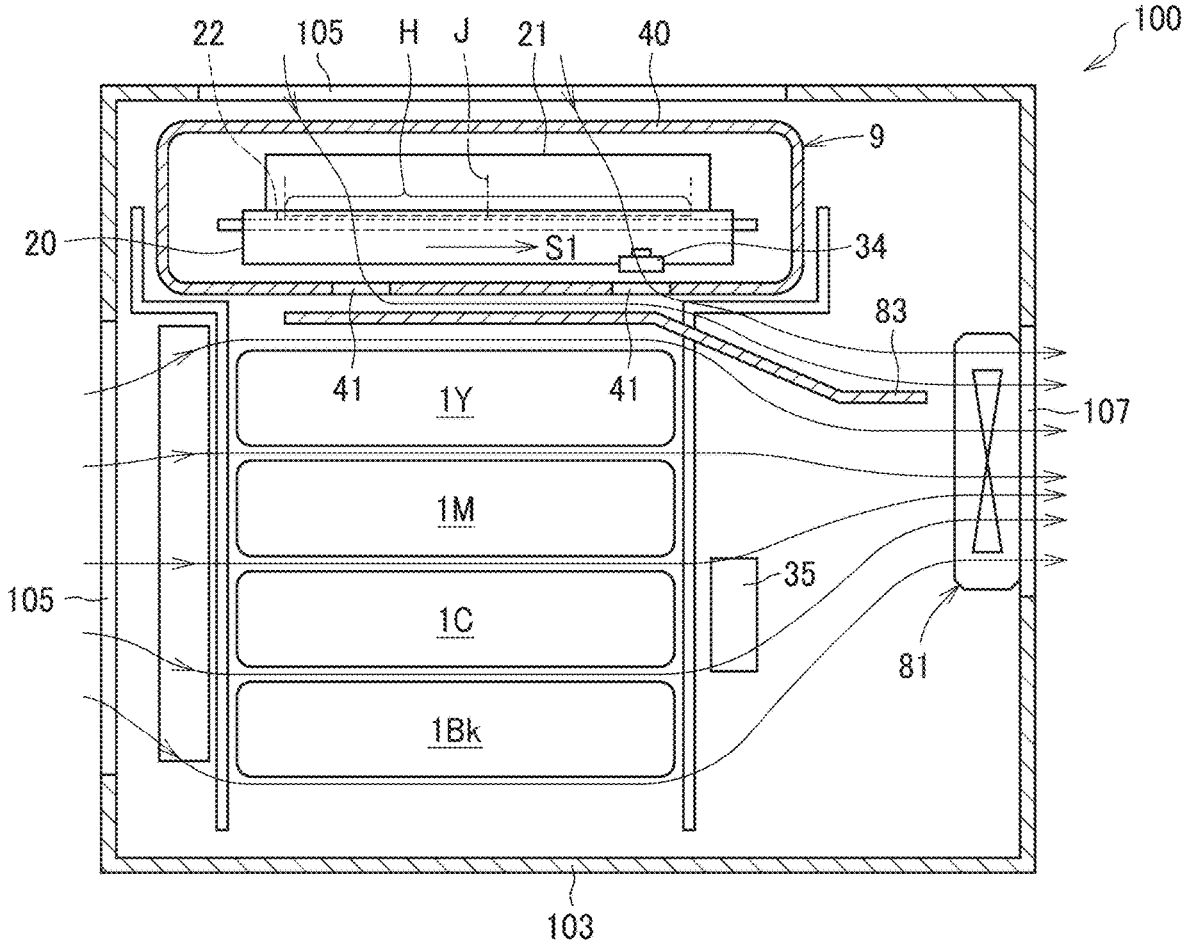
FIG. 17 is another cross-sectional plan view of the image forming apparatus, illustrating a second example of location of the temperature sensor in the longitudinal direction of the heater.

FIG. 16 is a cross-sectional plan view of the image forming apparatus 100, illustrating a first example of location of the temperature sensor 34 in the longitudinal direction of the heater 22. FIG. 17 is another cross-sectional plan view of the image forming apparatus 100, illustrating a second example of location of the temperature sensor 34 in the longitudinal direction of the heater 22.

The temperature sensor 34 may be disposed on a side corresponding to the left end side of the heater 22 in the longitudinal direction of the heater 22 as illustrated in FIG. 16. Alternatively, the temperature sensor 34 may be disposed on a side corresponding to the right end side of the heater 22, which is opposite the left end side of the heater 22, in the longitudinal direction of the heater 22 as illustrated in FIG. 17.

As in the example illustrated in FIG. 16, in a case in which the temperature sensor 34 is disposed on the side corresponding to the left end side of the heater 22 (in other words, the side in a second direction S2 opposite the first direction S1) from the center J of the heat generation span H, the position of the temperature sensor 34 is relatively close to a high-temperature portion of the heater 22. That is, the temperature sensor 34 easily detects the high-temperature portion of the fixing belt 20 and therefore detects an excessive temperature rise in advance. Accordingly, the safety is enhanced while the melting toner on the sheet P is prevented from adhering to a fixing rotator (in this case, the fixing belt 20) at high temperatures. In other words, the occurrence of so-called high temperature offset is prevented.

On the other hand, as in the example illustrated in FIG. 17, in a case in which the temperature sensor 34 is disposed on the side corresponding to the right end side of the heater 22 (in other words, the side in the first direction S1) from the center J of the heat generation span H, the position of the temperature sensor 34 is relatively close to a low-temperature portion of the heater 22. That is, the temperature sensor 34 easily detects the low-temperature portion of the fixing belt 20, thereby preventing the occurrence of so-called low temperature offset in which unmelted toner adheres to the fixing belt 20 because the heat amount is insufficient to melt the toner.

Figure 18:
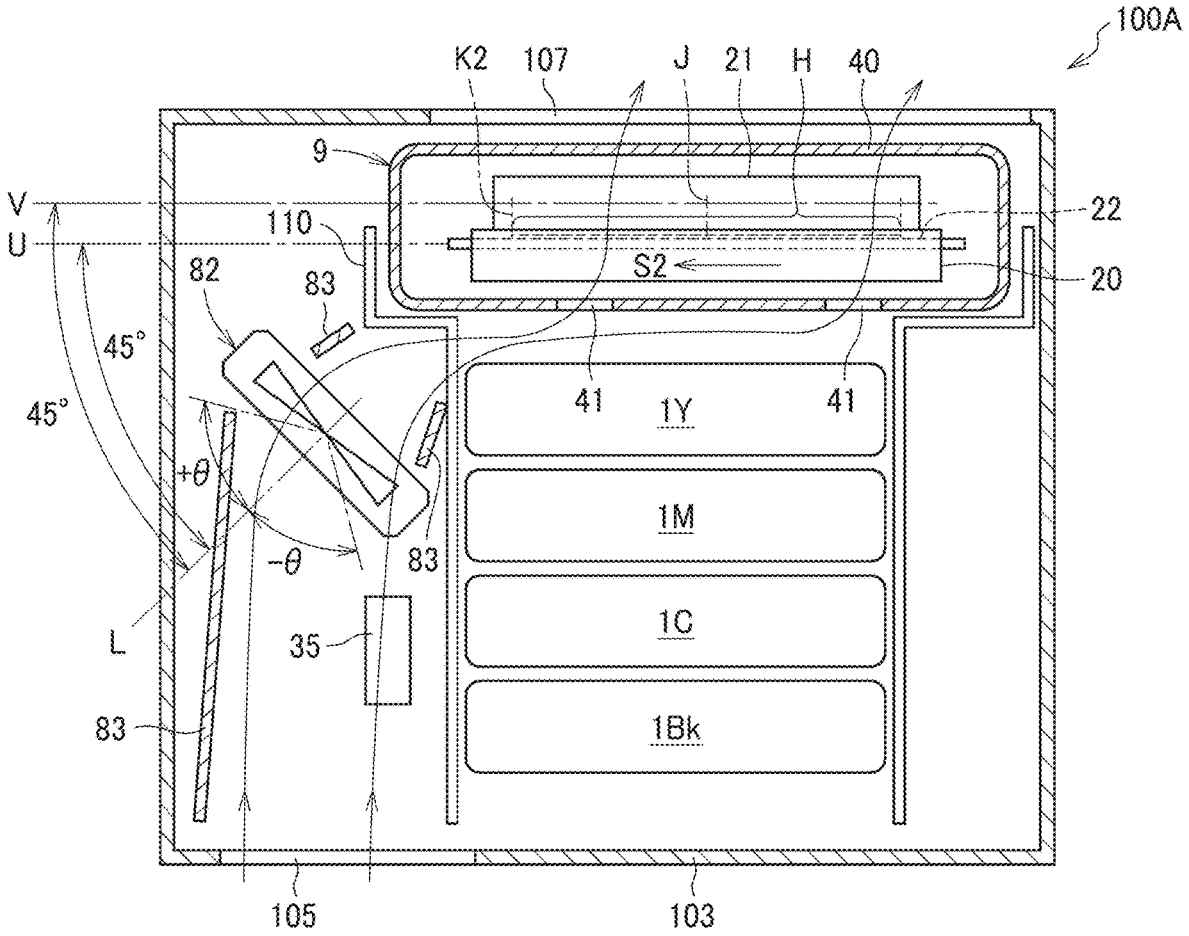
FIG. 18 is a cross-sectional plan view of an image forming apparatus according to another embodiment of the present disclosure.

Referring now to FIG. 18, a description is given of another embodiment of the present disclosure.

In the present embodiment, an intake fan 82 is disposed instead of the exhaust fan 81.

FIG. 18 is a cross-sectional plan view of an image forming apparatus 100A according to the present embodiment.

As illustrated in FIG. 18, in the present embodiment, the intake fan 82 serving as a cooler (or an airflow generator) is disposed inside the body 103 of the image forming apparatus 100A. Also, in the present embodiment, the intake port 105 is provided in a lower side wall of the body 103 in FIG. 18; whereas the exhaust port 107 is provided in an upper side wall of the body 103 in FIG. 18. The intake fan 82 is disposed closer to the intake port 105 than the fixing device 9. In other words, the intake fan 82 is disposed closer to the intake port 105 than the heater 22. As in the embodiment described above, the device frame 40 of the fixing device 9 is provided with the plurality of ventilation holes 41. The duct 83 is disposed between the ventilation holes 41 and the intake fan 82 to guide an airflow from the intake fan 82 to the ventilation holes 41.

In the present embodiment, the intake fan 82 is configured to generate an airflow from the intake port 105 to the exhaust port 107 to prevent the longitudinal unevenness in temperature of the heater 22 and the fixing belt 20. In other words, the intake fan 82, which is an airflow generator serving as a cooler, generates an airflow to the heater 22 left to right in FIG. 18, that is, from the left end side of the heater 22 higher in temperature to the right end side of the heater 22 lower in temperature. In other words, in FIG. 18, the left end side of the heater 22 higher in temperature is located on an upstream side of the airflow; whereas the right end side of the heater 22 lower in temperature is located on a downstream side of the airflow. Thus, the intake fan 82 effectively cools the higher-temperature side of the heater 22.

As illustrated in FIG. 18, the intake fan 82 is preferably disposed on a side closer to the intake port 105 from the center J of the heat generation span H. In other words, the intake fan 82 is preferably disposed on a side in the second direction S2 from the center J of the heat generation span H. Note that the second direction S2 is a direction indicated by arrow S2 from the right end side of the heater 22 lower in temperature to the left end side of the heater 22 higher in temperature in FIG. 18. More preferably, the intake fan 82 is disposed on the side in the second direction S2 from an end portion K2 of the heat generation span H in the second direction S2.

If the intake fan 82 is too close to the fixing device 9 or an internal frame 110 that supports the image forming units 1Y, 1M, 1C, and 1Bk, the fixing device 9 or the internal frame 110 resists an airflow generated by the intake fan 82, thus hampering an effective airflow generation. In order to effectively generate an airflow, the intake fan 82 is preferably disposed at a position slightly apart from the internal frame 110 or the fixing device 9. In the image forming apparatus 100A having a layout as illustrated in FIG. 18, the intake fan 82 effectively generates an airflow with the axial direction L of the intake fan 82 inclined at an angle of 45° with respect to the longitudinal direction U of the heater 22 or the axial direction V of the pressure roller 21.

In a case in which the intake fan 82 is hardly disposed such that the axial direction L of the intake fan 82 is inclined at an angle of 45° with respect to the longitudinal direction U of the heater 22 or the axial direction V of the pressure roller 21 due to layout reasons, the axial direction L of the intake fan 82 may be inclined at an angle of 45°±θ° with respect to the longitudinal direction U of the heater 22 or the axial direction V of the pressure roller 21. However, if the angle θ of the intake fan 82 is too large, the intake fan 82 might have difficulties in generating an airflow. To address such a situation, the angle θ is preferably within a range of ±60° (−60°≤θ≤+60°). More preferably, the angle θ is within a range of ±45° (i.e., −45°≤θ≤+45°), and even more preferably within a range of ±30° (i.e., −30°≤θ≤+30°).

Like the embodiment described above, in the present embodiment in which the intake fan 82 is disposed, the temperature sensor 34 disposed corresponding to (or opposite) the ventilation hole 41 (as illustrated in FIG. 14) prevents water droplets from adhering to the temperature sensor 34, and therefore prevents temperature detection errors, enhances the layout flexibility, and reduces manufacturing costs as an inexpensive temperature sensor is adoptable. In the present embodiment, the temperature sensor 34 can be disposed as in the examples illustrated in FIGS. 15 to 17. The advantages attained by the locations of the temperature sensor 34 illustrated in FIGS. 15 to 17 in the present embodiment are substantially the same as the advantages described above, and therefore a redundant description is herein omitted.

As described above, according to the embodiments of the present disclosure, even in a case in which heat generation of the feed lines 62 causes a longitudinal unevenness in temperature of the heater 22, the cooler (e.g., exhaust fan 81, intake fan 82) exhibits an enhanced cooling ability to the higher-temperature side of the heater 22, thus addressing the longitudinal unevenness in temperature of the heater 22 and the fixing belt 20. Accordingly, the embodiments prevent defects caused by the unevenness in temperature, such as the unevenness in glossiness, thus maintaining the image quality. Note that the embodiments are applicable to a case in which the connecting positions G1 and G2 of at least one of the resistive heat generators 59 and the first feed line 62A and the second feed line 62B, respectively, are located on the same side in the longitudinal direction U of the heater 22 or the heater 22V, in addition to the aforementioned case in which the connecting positions G1 and G2 of all the resistive heat generators 59 and the first feed line 62A and the second feed line 62B, respectively, are located on the same side in the longitudinal direction U of the heater 22 illustrated in FIG. 11A or the heater 22V illustrated in FIG. 13A.

Since the embodiments prevent such an unevenness in temperature, the current flowing to resistive heat generators can be increased to speed up an image forming apparatus. In addition, feed lines can be thinned to downsize a heater. In other words, even in a case in which the amount of heat generated by the feed lines becomes remarkable by an increased current flowing to the resistive heat generators or because the feed lines are thinned, the embodiments prevent the unevenness in temperature caused by the heat generation of the feed lines. Accordingly, at least one of the speeding up and downsizing of the image forming apparatus can be achieved.

Therefore, the embodiments attain a greater advantage when applied to a downsized heater, particularly to a heater downsized in a transverse direction of the heater.

Figure 19:
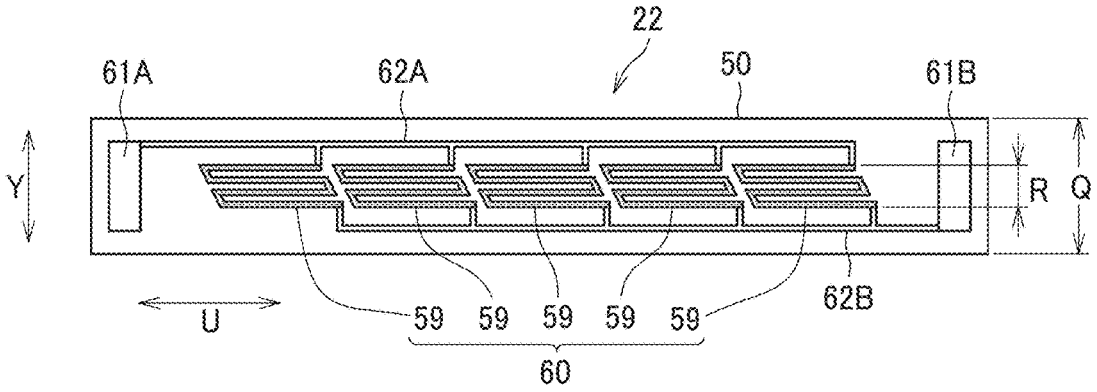
FIG. 19 is a plan view of the heater, illustrating a transverse dimension of the heater and a transverse dimension of the resistive heat generators.

FIG. 19 is a plan view of the heater 22, illustrating a transverse dimension Q of the heater 22 and a transverse dimension R of the resistive heat generators 59.

Specifically, in FIG. 19, Q represents the transverse dimension of the heater 22 (or the base 50); whereas R represents the transverse dimension of the resistive heat generators 59. Note that the transverse direction of each of the heater 22 and the plurality of resistive heat generators 59 intersects the longitudinal direction of the heater 22 along the surface of the heater 22 on which the heat generation unit 60 is disposed. In a case in which the embodiments are applied to the heater 22 in which a ratio (R/Q) of the transverse dimension R of the resistive heat generators 59 to the transverse dimension Q of the heater 22 is not less than 25%, a greater advantage can be attained. Note that the transverse dimension R of the resistive heat generators 59 refers to a transverse dimension of the entire resistive heat generator 59, not to a thickness of a linear portion of the resistive heat generator 59 folded back. In a case in which the embodiments are applied to the heater 22 having a ratio (R/Q) of not less than 40% in the transverse dimension, an even greater advantage can be attained.

Figure 20:
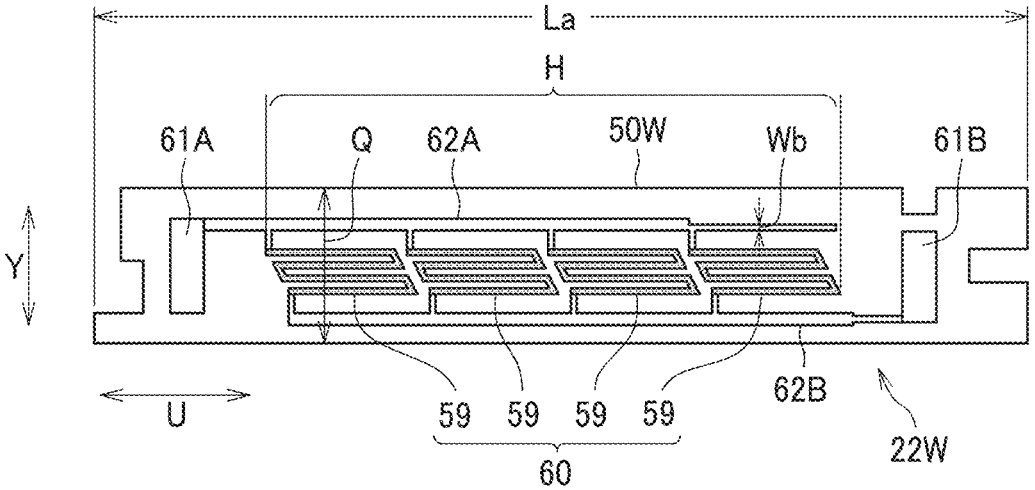
FIG. 20 is a plan view of a variation of the heater illustrated in FIG. 19, illustrating a longitudinal dimension of the variation of the heater, a transverse dimension of the variation of the heater, and a transverse dimension of the feed lines.

Referring now to FIG. 20, a description is given of a configuration of a heater 22W as a variation of the heater 22 illustrated in FIG. 19.

FIG. 20 is a plan view of the heater 22W, illustrating a longitudinal dimension La of the heater 22W, a transverse dimension Q of the heater 22W, and a transverse dimension Wb of the feed lines 62.

In the example illustrated in FIG. 19, the base 50 of the heater 22 is a rectangle and therefore the transverse dimension Q of the heater 22 remains unchanged at any longitudinal position of the heater 22. By contrast, in a case in which the base 50 has an uneven edge, the transverse dimension Q changes depending on the longitudinal position of the heater 22. For example, as illustrated in FIG. 20, a base 50W has an uneven edge and therefore the transverse dimension Q of the heater 22W changes depending on the longitudinal position of the heater 22W. In such a case, the transverse dimension Q of the heater 22W is a smallest dimension of the heater 22W in the transverse direction Y within the heat generation span H of the heater 22W over which all the resistive heat generators 59 are disposed.

The embodiments of the present disclosure are applicable to the heater 22 in which a ratio (Q/La) of the transverse dimension Q of the heater 22 to the longitudinal dimension La of the heater 22 is greater than 1.5% and less than 6%. The embodiments of the present disclosure are also applicable to the heater 22 in which a ratio (Wb/Q) of the transverse dimension Wb of one of the first feed line 62A and the second feed line 62B to the transverse dimension Q of the heater 22 is greater than 2% and less than 20%. Note that, in a case in which a longitudinal dimension of the base 50 changes depending on the portion, the longitudinal dimension La of the heater 22 is a largest dimension of the heater 22 in the longitudinal direction U. For example, as illustrated in FIG. 20, a longitudinal dimension of the base 50W changes depending on the portion and therefore the longitudinal dimension La of the heater 22W is a largest dimension of the heater 22W in the longitudinal direction U. The transverse dimension Wb of the one of the first feed line 62A and the second feed line 62B refers to a thickness of a linear portion of the one of the first feed line 62A and the second feed line 62B extending in the longitudinal direction U of the heater 22, excluding a portion of the one of the first feed line 62A and the second feed line 62B bent in the transverse direction Y of the heater 22 to join the resistive heat generator 59. In a case in which the thickness of the one of the first feed line 62A and the second feed line 62B changes depending on the longitudinal position of the heater 22, such as the heater 22W illustrated in FIG. 20, the transverse dimension Wb of the one of the first feed line 62A and the second feed line 62B refers to a smallest transverse dimension of the one of the first feed line 62A and the second feed line 62B within the heat generation span H.

As described above, the embodiments of the present disclosure prevent a longitudinal unevenness in temperature of a heater in which feed lines are connected to a resistive heat generator on one side in a longitudinal direction of the heater. Accordingly, such a heater can be positively adopted with the connecting positions of the feed lines and the resistive heat generator located on the same side in the longitudinal direction of the heater. As a consequence, the following advantages can be attained.

Figure 21:
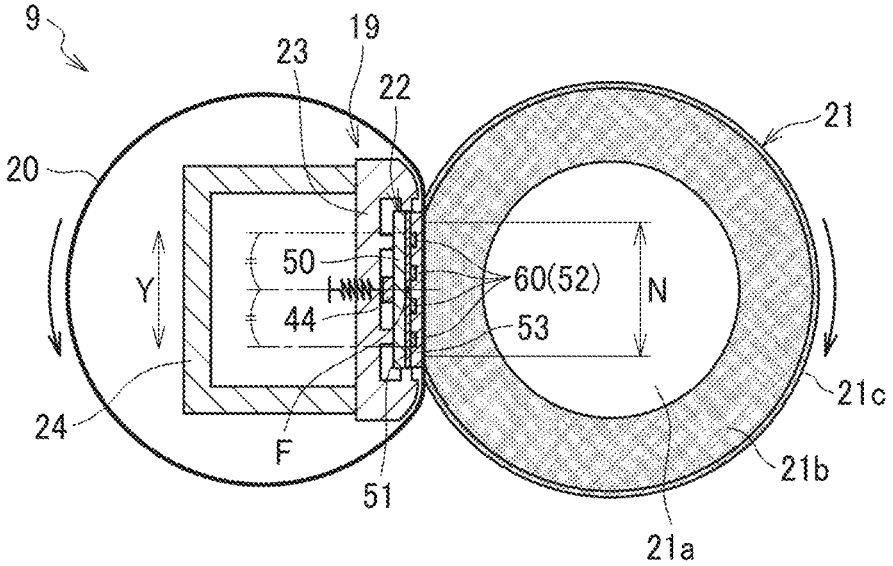
FIG. 21 is a schematic cross-sectional view of the fixing device, illustrating a heater temperature sensor provided for the heater.

FIG. 21 is a schematic cross-sectional view of the fixing device 9, illustrating a temperature sensor 44 (i.e., heater temperature sensor) provided for the heater 22.

In general, a fixing device having a planar heater includes a heater temperature detector to detect a temperature of the heater. In the example illustrated in FIG. 21, the temperature sensor 44 serves as a heater temperature detector that detects the temperature of the heater 22. The temperature sensor 44 is, e.g., a thermistor. The temperature sensor 44 contacts, e.g., a back surface of the heater 22 opposite the surface on which the heat generation unit 60 is disposed, to detect the temperature of the heater 22. According to the detected temperature of the heater 22, the temperature of the heater 22 or the fixing belt 20 is controlled. In general, the heater 22 has a higher temperature on a center side of the heat generation unit 60 in the transverse direction Y of the heater 22 than a temperature on an end side of the heat generation unit 60 in the transverse direction Y of the heater 22. In order to prevent overheating of the heater 22 in advance, the temperature sensor 44 is disposed at a position corresponding to a center F of the heat generation unit 60 in the transverse direction Y of the heater 22. Hereinafter, the position corresponding to the center F is simply referred to as a "transverse center position" or a "transverse center position F."

Figure 22:
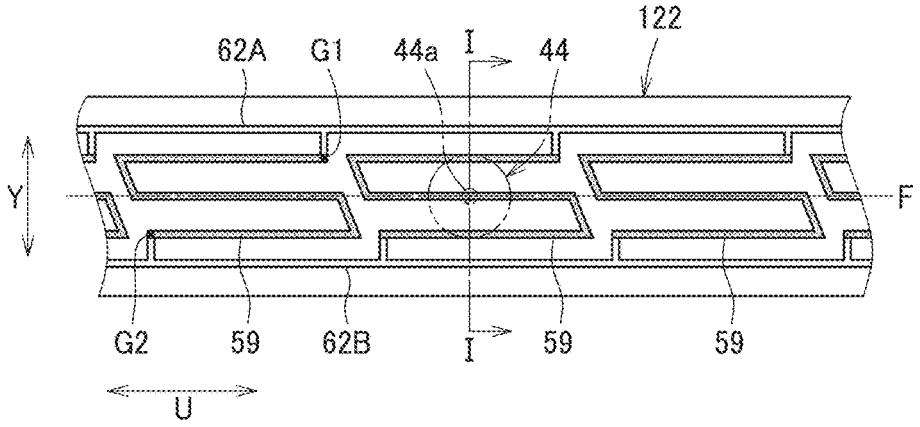
FIG. 22 is a schematic view of the comparative heater of FIG. 10A, illustrating the feed lines connected to each resistive heat generator on the opposite sides of each resistive heat generator in the longitudinal direction of the comparative heater, with a location of the heater temperature sensor in the transverse direction of the comparative heater.
Figure 23:
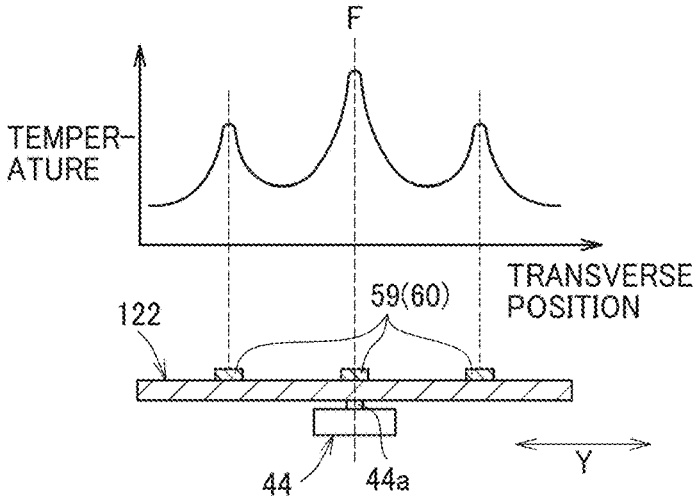
FIG. 23 is a graph of a temperature distribution of the comparative heater in an I-I cross section of FIG. 22, with a cross-sectional view of the comparative heater along a line I.

Referring now to FIGS. 22 and 23, a description is given of the relative positions of the temperature sensor 44 and the comparative heater 122.

FIG. 22 is a schematic view of the comparative heater 122 of FIG. 10A, illustrating the feed lines 62 connected to each of the resistive heat generators 59 on the opposite sides of each of the resistive heat generators 59 in the longitudinal direction of the comparative heater 122, with a location of the temperature sensor 44 (i.e., heater temperature sensor) in the transverse direction of the comparative heater 122. FIG. 23 is a graph of a temperature distribution of the comparative heater 122 in an I-I cross section of FIG. 22, with a cross-sectional view of the comparative heater 122 along a line I.

In the comparative heater 122 with the first feed line 62A and the second feed line 62B connected to each of the resistive heat generators 59 at the connecting positions G1 and G2, respectively, on the opposite sides in the longitudinal direction U of the comparative heater 122 as illustrated in FIG. 22, one of folded linear portions of each of the resistive heat generators 59 is located at the transverse center position F of the heat generation unit 60. Therefore, in a case in which the temperature sensor 44 is disposed at the transverse center position F of the heat generation unit 60 as described above, a temperature detection part 44*a* of the temperature sensor 44 is located on the resistive heat generator 59 at the transverse center position F of the heat generation unit 60. Note that the term "on the resistive heat generator" as used herein refers to a position overlapping the resistive heat generator 59 in a thickness direction, which is a direction intersecting the longitudinal direction U and the transverse direction Y of the heater 22 (or the comparative heater 122).

In this case, as illustrated in FIG. 23, a highest peak value is a temperature at the transverse center position F of the heat generation unit 60 at which the resistive heat generator 59 is located. The temperature sensor 44 detects the temperature of the peak value. However, since the temperature of the comparative heater 122 greatly changes in a very narrow range near the peak value, the detected temperature might greatly change if the temperature sensor 44 is slightly displaced in the transverse direction Y of the comparative heater 122, hampering an appropriate detection of the temperature of the comparative heater 122.

Figure 24:
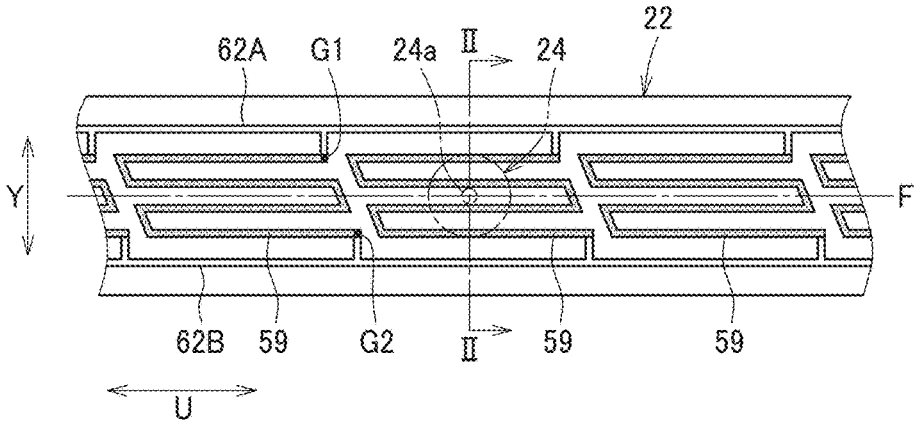
FIG. 24 is a schematic view of the heater of FIG. 7, illustrating the feed lines connected to each resistive heat generator on one side in the longitudinal direction of the heater, with a location of the heater temperature sensor in the transverse direction of the heater.
Figure 25:
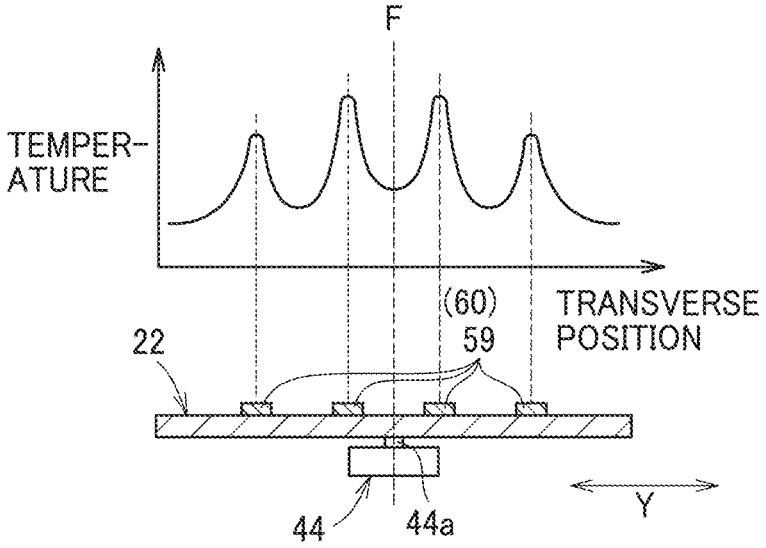
FIG. 25 is a graph of a temperature distribution of the heater in a II-II cross section of FIG. 24, with a cross-sectional view of the heater along a line II.

Referring now to FIGS. 24 and 25, a description is given of the relative positions of the temperature sensor 44 and the heater 22.

FIG. 24 is a schematic view of the heater 22 of FIG. 7, illustrating the feed lines 62 connected to each of the resistive heat generators on one side in the longitudinal direction of the heater 22, with a location of the temperature sensor 44 (i.e., heater temperature sensor) in the transverse direction of the heater 22. FIG. 25 is a graph of a temperature distribution of the heater 22 in a II-II cross section of FIG. 24, with a cross-sectional view of the heater 22 along a line II.

Contrary to the comparative heater 122 described above with reference to FIGS. 22 and 23, in the heater 22 with the first feed line 62A and the second feed line 62B connected to each of the resistive heat generators 59 at the connecting positions G1 and G2, respectively, on the same side in the longitudinal direction U of the heater 22 as illustrated in FIG. 24, the temperature detection part 44*a* is located not on the resistive heat generator 59 but at a position corresponding to an interval between longitudinal portions of the resistive heat generator 59 extending in the longitudinal direction U of the heater 22. In other words, the temperature detection part 44*a* is located at a position corresponding to a portion of the heater 22 without the resistive heat generator 59. Note that the term "position corresponding to an interval between longitudinal portions of the resistive heat generator 59 extending in the longitudinal direction U of the heater 22" as used herein refers to a position overlapping, in the thickness direction of the heater 22, a position in an interval between the longitudinal portions of the resistive heat generator 59 extending in the longitudinal direction U of the heater 22.

In this case, as illustrated in FIG. 25, the temperature sensor 44 detects a temperature between adjacent peak values of the heater 22. Since the temperature changes gently in a relatively wide range between the adjacent peak values, the detected temperature is unlikely to change even if the temperature sensor 44 is displaced in the transverse direction Y of the heater 22. Therefore, this case has an advantage in reducing differences in detected temperature caused by the displacement of the temperature sensor 44. Since the displacement of the temperature sensor 44 unlikely causes the differences in detected temperature, the temperature sensor 44 does not have to be installed with high accuracy. That is, the workability of installing the temperature sensor 44 is enhanced.

Note that, as in the heater 22 illustrated in FIG. 24, the temperature detection part 44*a* may be located between adjacent peak values in the comparative heater 122 illustrated in FIG. 22. However, in such a case, the adjacent peak values are different from each other in height (i.e., temperature) as illustrated in FIG. 23. Therefore, the amount of change in detected temperatures depends on which peak value the temperature sensor 44 is displaced to. From the viewpoint of reducing the differences in detected temperature, the configuration in which the connecting positions of the feed lines and the resistive heat generator are located on the same side in the longitudinal direction of the heater is preferable to the configuration in which the connecting positions of the feed lines and the resistive heat generator are located on the opposite sides in the longitudinal direction of the heater.

Compared to the comparative heater 122 in which the first feed line 62A and the second feed line 62B are connected to the resistive heat generator 59 on the opposite sides in the longitudinal direction of the comparative heater 122, the heater 22 in which the first feed line 62A and the second feed line 62B are connected to the resistive heat generator 59 on the same side in the longitudinal direction of the heater 22 has an advantage in arrangement of the temperature sensor 44 in the transverse direction Y of the heater 22.

Moreover, it is desirable to pay attention to the following points when disposing the temperature sensor 44 in the longitudinal direction U of the heater 22.

Figure 26:
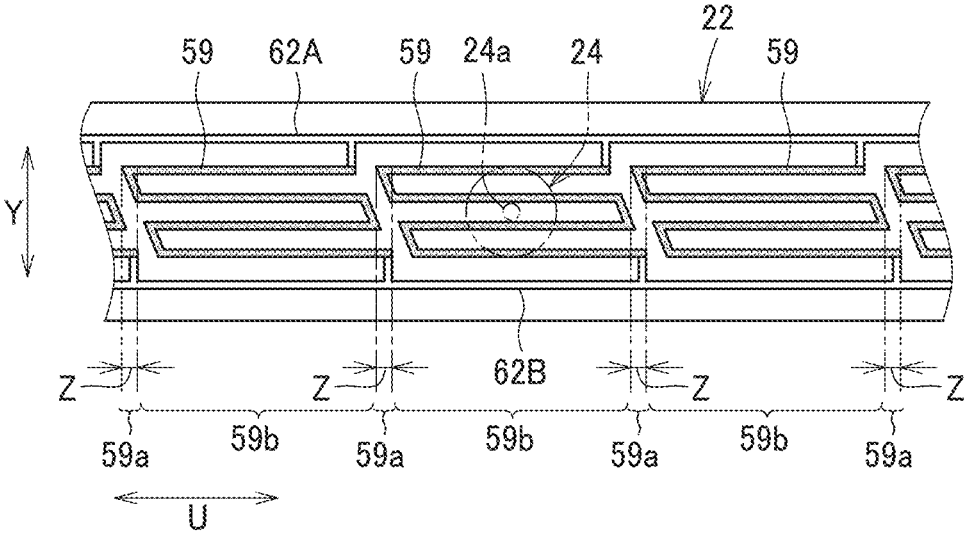
FIG. 26 is a schematic view of the heater, illustrating a location of the heater temperature sensor in the longitudinal direction of the heater.

FIG. 26 is a schematic view of the heater 22, illustrating a location of the temperature sensor 44 (i.e., heater temperature sensor) in the longitudinal direction U of the heater 22.

As illustrated in FIG. 26, in the present embodiment, opposed end portions of each of the resistive heat generators 59 in the longitudinal direction U of the heater 22 are inclined with respect to a sheet conveyance direction (i.e., vertical direction in FIG. 26), which is a direction in which the sheet P is conveyed. At least part of the respective end portions of the adjacent resistive heat generators 59 overlap each other in the longitudinal direction U of the heater 22. That is, at least part of the end portions of the adjacent resistive heat generators 59 are located in a common area Z in the longitudinal direction U of the heater 22. Specifically, the resistive heat generator 59 includes an overlapping portion 59*a* and a non-overlapping portion 59*b*. The overlapping portion 59*a* is located in the common area Z shared with the adjacent resistive heat generator 59 in the longitudinal direction U of the heater 22. By contrast, the non-overlapping portion 59*b* is not located in the common area Z shared with the adjacent resistive heat generator 59 in the longitudinal direction U of the heater 22.

The overlapping portion 59*a* reduces a temperature decrease between the adjacent resistive heat generators 59. However, compared to the non-overlapping portion 59*b*, the overlapping portion 59*a* tends to have greater temperature differences determined by position. Therefore, as illustrated in FIG. 26, the temperature detection part 44*a* of the temperature sensor 44 is preferably located at a position corresponding to the non-overlapping portion 59*b*, not to the overlapping portion 59*a*. Note that the term "position corresponding to the non-overlapping portion 59*b*" herein refers to a position overlapping the non-overlapping portion 59*b* in the thickness direction of the heater 22.

In the embodiments of the present disclosure, a resistive heat generator having a positive temperature coefficient (PTC) characteristic may be used to further prevent the longitudinal unevenness in temperature of the heater 22. The PTC characteristic is a characteristic in which the resistance value increases as the temperature increases, for example, a heater output decreases under a given voltage. The heat generation unit 60 having the PTC characteristic starts up quickly with an increased output at low temperatures and prevents overheating with a decreased output at high temperatures. For example, with a temperature coefficient of resistance (TCR) of the PTC characteristic in a range of from about 300 ppm/° C. to about 4,000 ppm/° C., the heater 22 is manufactured at reduced costs while retaining a sufficient resistance value for the heater 22. The TCR is preferably in a range of from about 500 ppm/° C. to about 2,000 ppm/° C.

The TCR can be calculated using the following equation (2). In the equation (2), T0 represents a reference temperature, T1 represents a freely selected temperature, R0 represents a resistance value at the reference temperature T0, and R1 represents a resistance value at the selected temperature T1. For example, in the heater 22 described above with reference to FIG. 7, the TCR is 2,000 ppm/° C. from the equation (2) when the resistance values between the first electrode 61A and the second electrode 61B are 10Ω (i.e., resistance value R0) and 12Ω (i.e., resistance value R1) at 25° C. (i.e., reference temperature T0) and 125° C. (i.e., selected temperature T1), respectively.

$$TCR=(R1-R0)/R0/(T1-T0)\times 10^6 \quad (2)$$

Referring now to FIGS. 27 to 30, a description is given of some variations of the heater 22 illustrated in FIG. 7.

In the embodiments described above, a description has been given of the heater 22 that causes the resistive heat generators 59 to generate heat at the same time. The embodiments are also applicable to a heater including resistive heat generators 59 that are separately controllable to generate heat as illustrated in FIG. 27.

Figure 27:
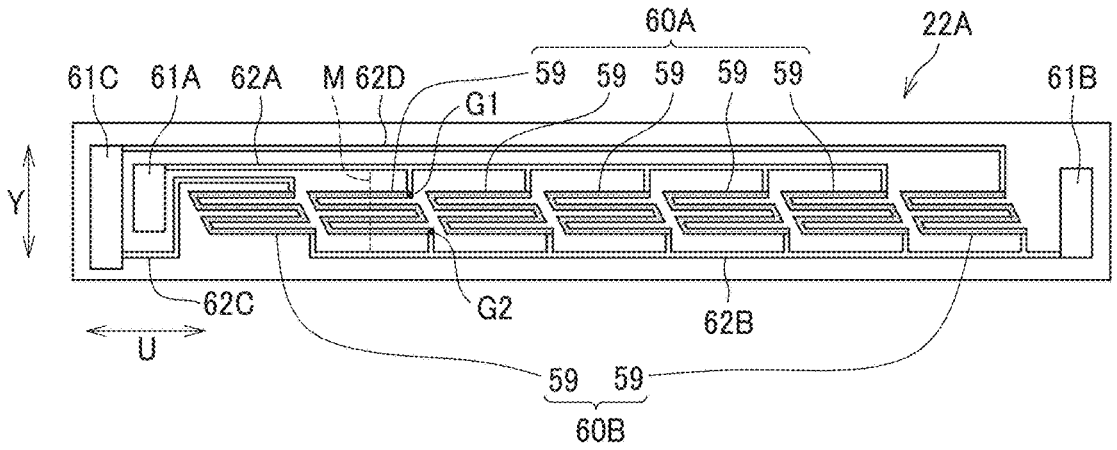
FIG. 27 is a plan view of a first variation of the heater illustrated in FIG. 7.

Referring now to FIG. 27, a description is given of a configuration of a heater 22A as a first variation of the heater 22 illustrated in FIG. 7.

FIG. 27 is a plan view of the heater 22A.

In the example illustrated in FIG. 27, a first heat generation group 60A and a second heat generation group 60B are separately controllable to generate heat. Specifically, the first heat generation group 60A is a first group of the resistive heat generators 59, which are other than the end resistive heat generators 59 (i.e., the resistive heat generators 59 arranged on the ends in the longitudinal direction U of the heater 22A) of the plurality of resistive heat generators 59. The second heat generation group 60B is a second group of the end resistive heat generators 59. Each of the resistive heat generators 59 of the first heat generation group 60A is connected to the first electrode 61A and the second electrode 61B through the first feed line 62A and the second feed line 62B, respectively. Each of the resistive heat generators 59 of the second heat generation group 60B is connected to the second electrode 61B through the second feed line 62B. Each of the resistive heat generators 59 of the second heat generation group 60B is also connected to a third electrode 61C through a third feed line 62C or a fourth feed line 62D.

When a voltage is applied to the first electrode 61A and the second electrode 61B, the resistive heat generators 59 other than the end resistive heat generators 59 are energized. Accordingly, the first heat generation group 60A generates heat alone. By contrast, when a voltage is applied to the first electrode 61A and the third electrode 61C, the end resistive heat generators 59 are energized. Accordingly, the second heat generation group 60B generates heat alone. When a voltage is applied to all the first to third electrodes 61A to 61C, the resistive heat generators 59 of both the first heat generation group 60A and the second heat generation group 60B (i.e., all the resistive heat generators 59) generate heat.

In such a configuration in which two heat generation groups (or groups of resistive heat generators), namely the first heat generation group 60A and the second heat generation group 60B, are separately controllable to generate heat, the aforementioned longitudinal unevenness in temperature of the heater 22A may occur as the feed lines 62 are connected to each of the resistive heat generators 59 at the connecting positions G1 and G2, respectively, on the same side with respect to the center M of each of the resistive heat generators 59 in the longitudinal direction U of the heater 22A. For example, when the first heat generation group 60A generates heat, the first feed line 62A and the second feed line 62B are energized and generate heat, causing the longitudinal unevenness in temperature of the heater 22A. The embodiments of the present disclosure prevent a longitudinal unevenness in temperature of the heater 22A having the configuration described above.

In the embodiments described above, either the exhaust fan 81 or the intake fan 82 is used as a cooler to prevent the longitudinal unevenness in temperature of the heater 22. Alternatively, both the exhaust fan 81 and the intake fan 82 may be used as coolers to prevent the longitudinal unevenness in temperature of the heater 22. Alternatively, a cooler other than the exhaust fan 81 or the intake fan 82 may be used.

Figure 28:
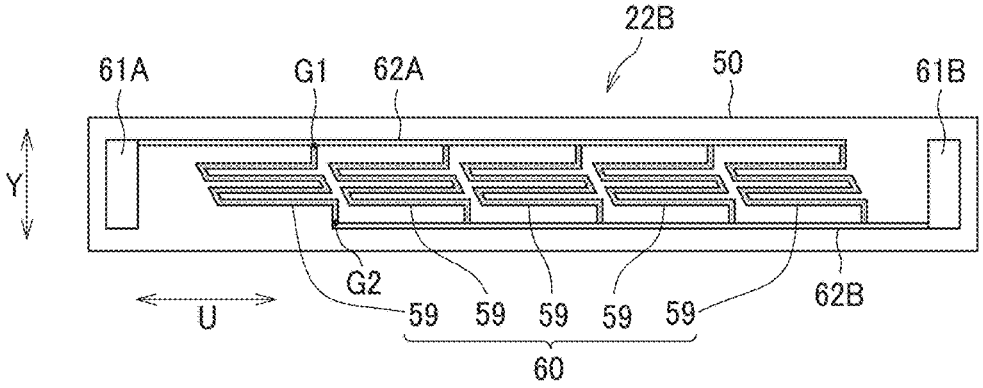
FIG. 28 is a plan view of a second variation of the heater illustrated in FIG. 7.

Referring now to FIG. 28, a description is given of a configuration of a heater 22B as a second variation of the heater 22 illustrated in FIG. 7.

FIG. 28 is a plan view of the heater 22B.

In the embodiments described above, each of the first feed line 62A and the second feed line 62B has a transverse portion extending in the transverse direction Y of the heater 22 as illustrated in FIG. 7 and connected to each of the resistive heat generators 59. However, the transverse portion that connects each of the first feed line 62A and the second feed line 62B to each of the resistive heat generators 59 is not limited to a part of each of the first feed line 62A and the second feed line 62B. Alternatively, as in the example illustrated in FIG. 28, the transverse portion may be a part of each of the resistive heat generators 59.

Figure 29:
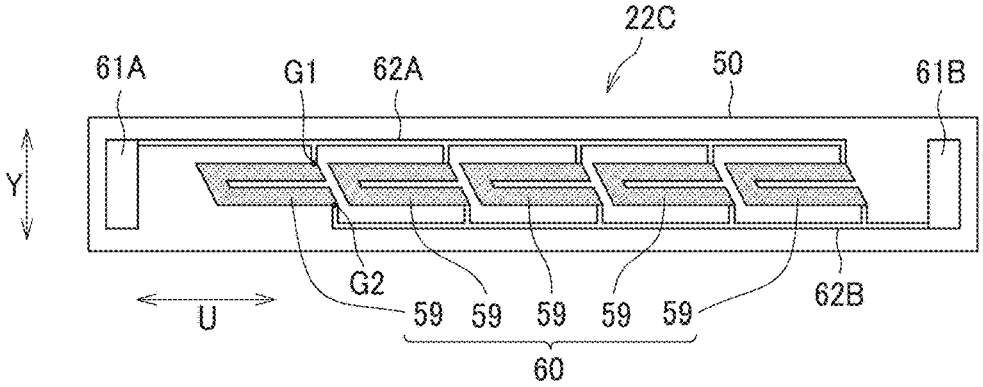
FIG. 29 is a plan view of a third variation of the heater illustrated in FIG. 7.
Figure 30:
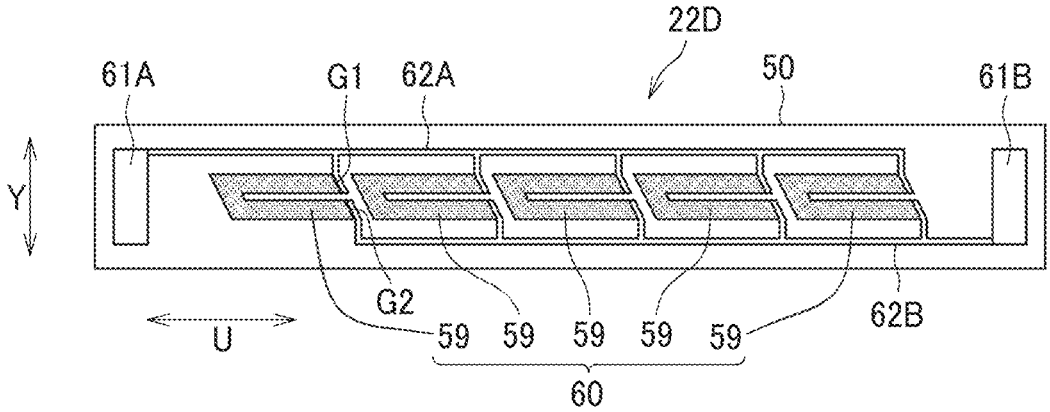
FIG. 30 is a plan view of a fourth variation of the heater illustrated in FIG. 7.

Referring now to FIGS. 29 and 30, a description is given of a configuration of a heater 22C as a third variation of the heater 22 illustrated in FIG. 7 and a configuration of a heater 22D as a fourth variation of the heater 22 illustrated in FIG. 7, respectively.

FIG. 29 is a plan view of the heater 22C. FIG. 30 is a plan view of the heater 22D.

In the embodiments described above, each of the resistive heat generators 59 is turned a plurality of times. In other words, each of the resistive heat generators 59 has a plurality of corner portions. Alternatively, the number of turns (i.e., the number of corner portions) of each of the resistive heat generators 59 may be one as illustrated in FIGS. 29 and 30. Each of the connecting position G1 of the first feed line 62A and each of the resistive heat generators 59 and the connecting position G2 of the second feed line 62B and each of the resistive heat generators 59 may be a corner of an end portion of each of the resistive heat generators 59 as illustrated in FIG. 29. Alternatively, as illustrated in FIG. 30, each of the connecting positions G1 and G2 may be an entire edge, extending in the transverse direction Y, of the end portion of each of the resistive heat generators 59.

Figure 31:
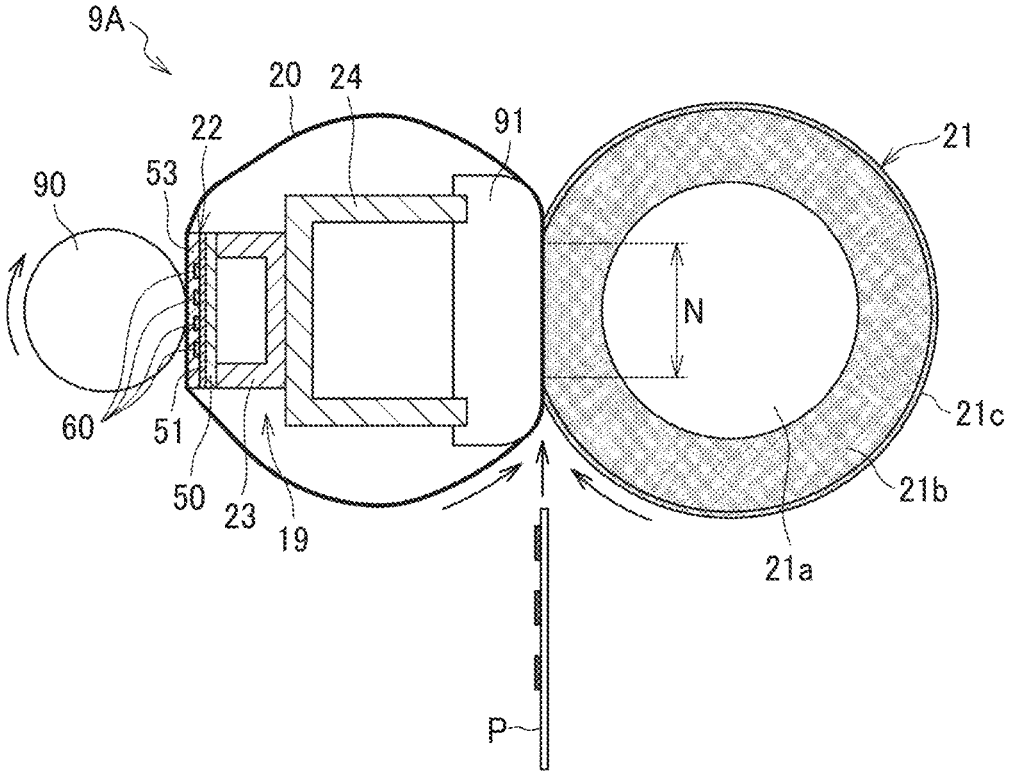
FIG. 31 is a cross-sectional view of a first variation of the fixing device illustrated in FIG. 2.
Figure 32:
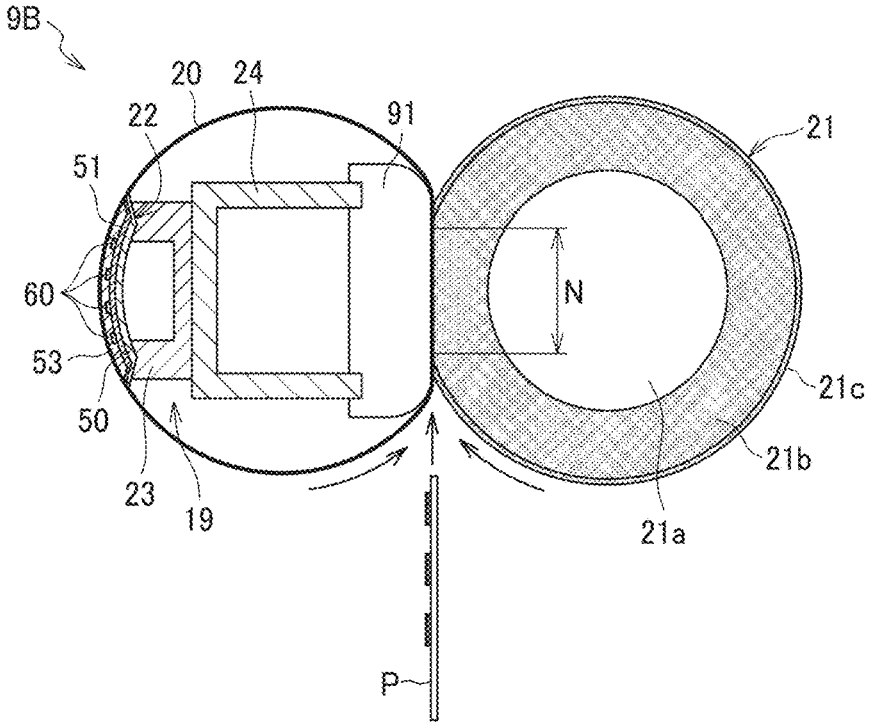
FIG. 32 is a cross-sectional view of a second variation of the fixing device illustrated in FIG. 2.
Figure 33:
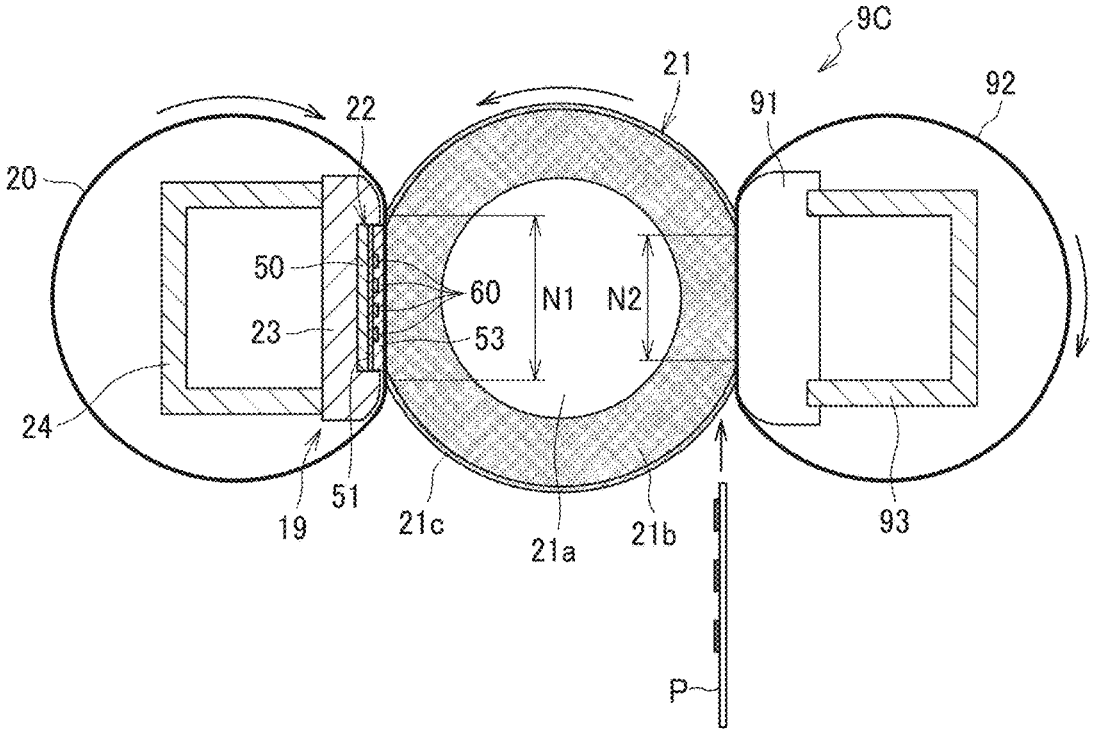
FIG. 33 is a cross-sectional view of a third variation of the fixing device illustrated in FIG. 2.

The embodiments of the present disclosure are also applicable to fixing devices as illustrated in FIGS. 31 to 33, respectively, other than the fixing device 9 described above.

Referring now to FIGS. 31 to 33, a description is given of some variations of the fixing device 9.

Initially with reference to FIG. 31, a description is given of a configuration of a fixing device 9A as a first variation of the fixing device 9.

FIG. 31 is a cross-sectional view of the fixing device 9A.

As illustrated in FIG. 31, the fixing device 9A includes a pressing roller 90 disposed opposite the pressure roller 21 via the fixing belt 20. The heater 22 sandwiches the fixing belt 20 together with the pressing roller 90 to heat the fixing belt 20. On the other hand, a nip formation pad 91 is disposed inside the loop formed by the fixing belt 20 and opposite the pressure roller 21. The stay 24 supports the nip formation pad 91. The nip formation pad 91 sandwiches the fixing belt 20 together with the pressure roller 21 to form the fixing nip N between the fixing belt 20 and the pressure roller 21.

Referring now to FIG. 32, a description is given of a configuration of a fixing device 9B as a second variation of the fixing device 9.

FIG. 32 is a cross-sectional view of the fixing device 9B.

As illustrated in FIG. 32, the fixing device 9B does not include the pressing roller 90 described above with reference to FIG. 31. In order to attain a contact length for which the heater 22 contacts the fixing belt 20 in the circumferential direction of the fixing belt 20, the heater 22 is curved into an arc in cross section conforming to a curvature of the fixing belt 20. The rest of the configuration of the fixing device 9B is substantially the same as the rest of the configuration of the fixing device 9A described above with reference to FIG. 31.

Referring now to FIG. 33, a description is given of a configuration of a fixing device 9C as a third variation of the fixing device 9.

FIG. 33 is a cross-sectional view of the fixing device 9C.

As illustrated in FIG. 33, the fixing device 9C includes a pressure belt 92 in addition to the fixing belt 20. The pressure belt 92 and the pressure roller 21 form a fixing nip N2 serving as a secondary nip separately from a heating nip N1 serving as a primary nip formed between the fixing belt 20 and the pressure roller 21. Specifically, the nip formation pad 91 and a stay 93 are disposed opposite the fixing belt 20 via the pressure roller 21. The pressure belt 92 is rotatably disposed while accommodating the nip formation pad 91 and the stay 93. As a sheet P bearing a toner image is conveyed through the fixing nip N2 formed between the pressure belt 92 and the pressure roller 21, the pressure belt 92 and the pressure roller 21 fix the toner image onto the sheet P under heat and pressure. The rest of the configuration of the fixing device 9C is substantially the same as the rest of the configuration of the fixing device 9 described above with reference to FIG. 2.

The image forming apparatus incorporating the fixing device according to an embodiment described above is not limited to a color image forming apparatus as illustrated in FIG. 1. Alternatively, the image forming apparatus may be a monochrome image forming apparatus that forms a monochrome toner image on a recording medium. In addition, the image forming apparatus to which the embodiments of the present disclosure are applied includes, but is not limited to, a printer, a copier, a facsimile machine, or a multifunction peripheral having at least two capabilities of these devices. In addition to the electrophotographic image forming apparatus incorporating the fixing device as described above, the embodiments of the present disclosure are applicable to an inkjet image forming apparatus including a drying device that dries ink applied to a sheet. The embodiments of the present disclosure are also applicable to a heat press machine including a heat press part that heats and presses a target object, such as a laminator that heats and presses a film as a covering material on a surface of a sheet such as paper or a heat sealer that heats and presses a sealing part of a packaging material. Such an inkjet image forming apparatus and a heat press machine to which an embodiment of the present disclosure is applied prevent a longitudinal unevenness in temperature of a heater and cope with downsizing and increase in speed.

According to the embodiments described above, the unevenness in temperature of a heater is prevented.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. An image forming apparatus comprising:

a heater including:

a heat generation unit including resistive heat generators arranged in a longitudinal direction of the heater;

a first electrode;

a second electrode;

a first conductor configured to connect the resistive heat generators;

a second conductor configured to connect the resistive heat generators;

the first conductor and the second conductor connected to at least one resistive heat generator of the resistive heat generators on a longitudinal end side of the resistive heat generator in the longitudinal direction of the heater, a heater temperature detector configured to detect a temperature of the heater, wherein the resistive heat generators are shaped to reciprocate in the longitudinal direction of the heater via a corner portion, and wherein the heater temperature detector is disposed at a position corresponding to an interval between longitudinal portions of the resistive heat generator extending in the longitudinal direction of the heater, wherein the heat generation unit is configured to generate heat asymmetrically in the longitudinal direction.

2. The image forming apparatus according to claim 1, wherein the resistive heat generators include an adjacent resistive heat generator adjacent to the at least one resistive heat generator, wherein the resistive heat generators include:

an overlapping portion located in a common area shared with the adjacent resistive heat generator in the longitudinal direction of the heater; and a non-overlapping portion not located in the common area shared with the adjacent resistive heat generator in the longitudinal direction of the heater, and wherein the heater temperature detector is disposed at a position corresponding to the non-overlapping portion.

3. The image forming apparatus according to claim 1, wherein a ratio of a transverse dimension of the heater to a longitudinal dimension of the heater is greater than 1.5% and less than 6%, and wherein a transverse direction of the heater intersects the longitudinal direction of the heater along a surface of the heater on which the heat generation unit is disposed.

4. The image forming apparatus according to claim 1, wherein a ratio of a transverse dimension of one of the first conductor and the second conductor to a transverse dimension of the heater is greater than 2% and less than 20%, and wherein a transverse direction of each of the heater and the one of the first conductor and the second conductor intersects the longitudinal direction of the heater along a surface of the heater on which the heat generation unit is disposed.

5. The image forming apparatus according to claim 1, wherein a ratio of a transverse dimension of the resistive heat generators to a transverse dimension of the heater is not less than 25%, and wherein a transverse direction of each of the heater and the resistive heat generators intersects the longitudinal direction of the heater along a surface of the heater on which the heat generation unit is disposed.

6. The image forming apparatus according to claim 1, wherein a ratio of a transverse dimension of the resistive heat generators to a transverse dimension of the heater is not less than 40%, and wherein a transverse direction of each of the heater and the resistive heat generators intersects the longitudinal direction of the heater along a surface of the heater on which the heat generation unit is disposed.

7. The image forming apparatus according to claim 1, further includes a cooler to cool the heater, wherein the cooler includes an airflow generator, and wherein the airflow generator is configured to generate an airflow to the heater.

8. The image forming apparatus according to claim 7, further comprising:

a device frame configured to support the heater, the device frame having a ventilation hole; and a ventilation channel disposed between the airflow generator and the ventilation hole to guide the airflow.

9. The image forming apparatus according to claim 8, further comprising:

an endless belt configured to contact the heater; and an opposed rotator configured to contact the endless belt to form a fixing nip between the endless belt and the opposed rotator, wherein the ventilation hole is located closer to the endless belt than to the opposed rotator.

10. The image forming apparatus according to claim 9, further comprising a belt temperature detector disposed opposite the ventilation hole to detect a temperature of the endless belt.

11. The image forming apparatus according to claim 10, wherein the belt temperature detector includes a temperature detection part, and wherein an upper end of the temperature detection part is located above an upper end of the heater in a gravity direction.

12. The image forming apparatus according to claim 10, wherein the heater temperature detector is on a side of the heater opposite the resistive heat generators.

13. The image forming apparatus according to claim 10, wherein the heater temperature detector includes a temperature detection part facing the heater and a body supporting the temperature detection part.

14. The image forming apparatus according to claim 7, further comprising a body having an intake port configured to take in air from outside and an exhaust port configured to exhaust the air outside, wherein the airflow generator is an exhaust fan disposed closer to the exhaust port than the heater, and wherein an axial direction of the exhaust fan is inclined at an angle within a range of ±60° with respect to the longitudinal direction of the heater.

15. The image forming apparatus according to claim 7, further comprising a body having an intake port configured to take in air from outside and an exhaust port configured to exhaust the air outside, wherein the airflow generator is an intake fan disposed closer to the intake port than the heater, and wherein an axial direction of the intake fan is inclined at an angle within a range of 45°±60° with respect to the longitudinal direction of the heater.

16. An image forming apparatus comprising:

an airflow generator configured to generate an airflow;

a heater including:

a heat generation unit including resistive heat generators arranged in a longitudinal direction of the heater;

a first electrode;

a second electrode;

a first conductor configured to connect the resistive heat generators in parallel with each other to the first electrode;

a second conductor configured to connect the resistive heat generators in parallel with each other to the second electrode, the first conductor and the second conductor connected to at least one resistive heat generator of the resistive heat generators on a longitudinal end side of the resistive heat generator in the longitudinal direction of the heater, and a heater temperature detector configured to detect a temperature of the heater, wherein the resistive heat generators are shaped to reciprocate in the longitudinal direction of the heater via a corner portion, and wherein the heater temperature detector is disposed at a position corresponding to an interval between longitudinal portions of the resistive heat generator extending in the longitudinal direction of the heater, wherein the heat generation unit is configured to generate heat asymmetrically in the longitudinal direction.

* * * * *